US007513756B2

(12) United States Patent
Aoki et al.

(10) Patent No.: US 7,513,756 B2
(45) Date of Patent: Apr. 7, 2009

(54) FUEL SUPPLY PUMP AND TAPPET STRUCTURE BODY

(75) Inventors: Nobuo Aoki, Shiki (JP); Kazuya Kubota, Higashimatsuyama (JP); Takeshi Terada, Tsurugashima (JP); Noriyuki Kobayashi, Higashimatsuyama (JP)

(73) Assignee: Bosch Automotive Systems Corporation, Tokyo (JP)

( * ) Notice: Subject to any disclaimer, the term of this patent is extended or adjusted under 35 U.S.C. 154(b) by 604 days.

(21) Appl. No.: 11/018,220

(22) Filed: Dec. 21, 2004

(65) Prior Publication Data

US 2005/0106049 A1 May 19, 2005

Related U.S. Application Data

(63) Continuation of application No. PCT/JP03/13688, filed on Oct. 27, 2003, now abandoned.

(30) Foreign Application Priority Data

| | | |
|---|---|---|
| Oct. 29, 2002 | (JP) | 2002-313763 |
| Jan. 10, 2003 | (JP) | 2003-004013 |
| Apr. 24, 2003 | (JP) | 2003-120627 |

(51) Int. Cl.
*F04B 19/00* (2006.01)
*F01B 31/10* (2006.01)

(52) U.S. Cl. ..... 417/470; 92/153

(58) Field of Classification Search ..... 417/470; 92/153, 154, 130 C; 123/500–504
See application file for complete search history.

(56) References Cited

U.S. PATENT DOCUMENTS

| | | | | |
|---|---|---|---|---|
| 2,126,985 | A * | 8/1938 | Buckwalter | 417/494 |
| 4,754,737 | A * | 7/1988 | Ishida et al. | 123/500 |
| 5,775,203 | A | 7/1998 | Osborn et al. | |
| 6,216,583 | B1 | 4/2001 | Klinger et al. | |
| 6,406,269 | B1 * | 6/2002 | Dingle et al. | 417/218 |

FOREIGN PATENT DOCUMENTS

| | | |
|---|---|---|
| JP | 61-134566 | 8/1986 |
| JP | 06-93936 | 4/1994 |
| JP | 09-4542 | 1/1997 |
| JP | 2885076 | 2/1999 |
| JP | 11-200989 A | 7/1999 |
| JP | 2001-221131 | 8/2001 |

* cited by examiner

*Primary Examiner*—Charles G Freay
(74) *Attorney, Agent, or Firm*—Carmody & Torrance LLP

(57) ABSTRACT

A fuel supply pump with a large fuel discharge amount and a tappet structure body, which are suitably used for an accumulated pressure-type fuel injection device that mechanically amplifies pressure, is provided. A fuel supply pump has a tappet structural body and a spring sheet, wherein a penetration portion for allowing passage of a lubricant or a fuel for lubrication therethrough by coordinating the tappet structure and the spring sheet is provided between a spring-holding chamber for holding a spring to be used for pulling up a plunger and a cam chamber for housing a cam to be used for moving the plunger up and down.

8 Claims, 23 Drawing Sheets

(a)

(b)

(a)

(b)

(a)

(b)

(a)

(b)

(c)

(a)

(b)

(a)

(b)

(a)

(b)

(c)

(a)

(b)

FUEL SUPPLY PUMP AND TAPPET STRUCTURE BODY

CROSS REFERENCE TO RELATED APPLICATIONS

This application is a continuation of International Application PCT/JP2003/013688, with an international filing date of Oct. 27, 2003, now abandoned.

TECHNICAL FIELD

The present invention relates to a fuel supply pump and a tappet structure body. More specifically, the present invention relates to a fuel supply pump, for example, which is suitable for an accumulator fuel injection device that mechanically amplifies the pressure of a large flow rate of fuel through the use of a pressure amplifying piston, and to a tappet structure body.

BACKGROUNDS

Conventionally, various accumulator fuel injection devices (CRSs: Common Rail Systems) using pressure accumulators (common rails) have been proposed in order to inject high-pressure fuels efficiently in diesel engines and so on.

For instance, as shown in FIG. 25, for switching the pressures of a pressure accumulator depending on the driving conditions of an engine, JP 06-93936 A has proposed an accumulator fuel injection device having a first pressure accumulator 236 responsible for a main injection and a second pressure accumulator 278 responsible for a pilot injection. These pressure accumulators 236, 278 are switched by a switching device 286 to carry out a fuel injection.

For obtaining the injection pressure perfect for engine performance, JP 2885076 B has proposed an accumulator fuel injection device having a pressure-amplifying piston for amplifying the pressure of a fuel and a cylinder chamber, located between a pressure accumulator and a fuel injection valve.

More specifically, as shown in FIG. 26, there is disclosed an accumulator fuel injection device 380 that comprises: a pressure accumulator 395; an oil supply channel 360 for a fuel; an oil control channel 361; a switching valve 362 for fuel injection control; a pressure amplifying piston 378 for elevating the fuel pressure to 70 to 120 MPa (approximately 700 to 1,200 kgf/cm$^2$); a cylinder chamber 383 for housing the pressure amplifying piston 378; a hydraulic circuit 363; a piston-work switching valve (three-way solid valve for amplifier) 364; and a controller (not shown).

However, the accumulator fuel injection device disclosed in JP 06-93936 A needs to be provided with two kinds of the pressure accumulator, their switching device, and so on. Therefore, there is a problem in that the accumulator fuel injection device is complicated and grown in size. In the accumulator fuel injection device, furthermore, there is another problem in that the lubricant prevents the movement of a plunger and fuel having a large flow rate cannot be pressurized sufficiently because of lubricant cannot travel forward and backward freely between a spring-holding member and a cam chamber when the cam and plunger of the fuel supply pump are driven at high speed. As the flow rate of fuel is restricted, a large amount of fuel cannot be pressurized sufficiently.

For the accumulator fuel injection device disclosed in JP 2885076B, a pressure amplifying piston is placed between the pressure accumulator and the fuel injection valve to intend to provide a multi-stage pressure injection. In this case, there is also proposed a pressure pump for supplying high-pressure fuel to the pressure accumulator. However, such a pressure pump is one of the conventional pressure pumps used for the conventional accumulator fuel injection devices. Any pressure pump, which intends to supply a large amount of high-pressure fuel, is not designed.

Therefore, as a result of concentrated study, the present inventors has found out that, by providing a penetration portion between a spring-holding chamber and a cam chamber, a large amount of a fuel oil can be sufficiently pressurized even when the cam and the plunger are driven at high speed because of allowing a lubricant or a fuel for lubrication to move forward and backward without restraint.

Specifically, an object of the present invention is to provide a fuel supply pump enough to pressurize fuel by driving a cam and a plunger at high speed without allowing a lubricant or a fuel for lubrication to inhibit the movement of a plunger even in the case of enlarging the amount of fuel discharged, and to provide a tappet structural body suitable for such a pump.

DISCLOSURE OF THE INVENTION

[1] According to the present invention, the above problems can be solved by providing a fuel supply pump equipped with a tappet structure body and a spring sheet, where a penetration portion is formed between a spring-holding chamber for holding a spring used when a plunger is pulled down, and a cam chamber for housing a cam for lifting/lowering the plunger.

That is, for pressurizing the fuel, when the plunger moves upward, a lubricant or a fuel for lubrication found in the spring-holding chamber moves quickly and smoothly to the cam chamber through the penetration portion. On the other hand, when the plunger moves down to inhale fuel, the lubricant or the fuel for lubrication found in the cam chamber moves quickly and smoothly to the spring-holding chamber through the penetration portion. Therefore, even in the case of driving the cam and the plunger at high speed, for example, revolving the cam at a high speed of 1,500 rpm or more to drive the plunger at high speed, the lubricant or the fuel for lubrication can move forward and backward freely between the spring-holding chamber and the came chamber. Therefore, a large amount of fuel can be pressurized because of a decrease in chance of inhibiting a high speed movement of the plunger. Therefore, a large amount of fuel can be pressurized.

[2] In addition, for constructing the fuel supply pump of the present invention, it is preferable that the spring sheet comprises a spring holding portion for holding the spring used when the plunger of the fuel supply pump is pulled down and a plunger mounting portion for catching the plunger, wherein a pass-through hole is provided around the plunger mounting portion as a part of the penetration portion to allow the lubricant or the fuel for lubrication to pass through the penetration portion.

As constructed above, even in the case of driving the plunger at high speed, the lubricant or the fuel for lubrication is allowed to move forward and backward smoothly between the spring side and the cam side through the pass-through hole of the spring sheet.

[3] Furthermore, for constructing the fuel supply pump, it is preferable that a plurality of pass-through holes are formed in the spring sheet and arranged around the plunger mounting portion in a radial pattern or in a semi-radial pattern.

As constructed above, regardless of an assembling alignment of the spring sheet, the penetration portion can be easily formed between the spring sheet and the tappet structure body without fail.

[4] Furthermore, for constructing the fuel supply pump of the present invention, it is preferable that the tappet structure body comprises a roller and a roller body, wherein a pass-through hole for allowing the lubricant or the fuel for lubrication to pass through the penetration portion is formed in the roller body as part of the penetration portion.

As constructed above, even in the case of driving the plunger at high speed, the fuel for lubrication is allowed to move forward and backward more smoothly between the spring side and the cam side through the pass-through hole of the roller body.

[5] Moreover, for constructing the fuel supply pump of the present invention, it is preferable that a plurality of pass-through holes is arranged in the peripheral direction of the roller body.

As constructed as, regardless of an assembling alignment of the tappet structure body, the penetration portion can be easily formed between the spring sheet and the tappet structure body without fail.

[6] Furthermore, for constructing the fuel supply pump of the present invention, it is preferable that a pass-through hole for allowing the lubricant or the fuel for lubrication to pass through the penetration portion is formed in the roller body as part of the penetration portion, and also a channel for allowing the passage of the lubricant or the fuel for lubrication is formed in an area including an opening of the pass-through hole on the upper surface of the roller body.

As constructed above, regardless of an assembling alignment of the tappet structure body, the penetration portion can be easily formed through the roller body without fail.

[7] Furthermore, for constructing the fuel supply pump of the present invention, it is preferable that a pass-through hole for allowing the lubricant or the fuel for lubrication to pass through the penetration portion is formed in the roller body as part of the penetration portion, and also a channel for allowing the passage of the lubricant or the fuel for lubrication is formed in an area including an opening of the pass-through hole on the lower side thereof.

As constructed above, regardless of an assembling alignment of the tappet structural body, the penetration portion can be easily formed through the roller body without fail.

[8] Furthermore, for constructing the fuel supply pump of the present invention, it is preferable that a fuel lubrication system, in which part of a fuel oil is used as a fuel for lubrication, is employed and also the penetration portion allows the fuel for lubrication to pass through the penetration portion.

As constructed above, even though a large amount of fuel to be pressurized and a fuel for lubrication as a lubrication component are partially mixed, no decrease in clean-up efficiency of exhaust gas will occur because they are made of the same component.

[9] Furthermore, for constructing the fuel supply pump of the present invention, it is preferable to use an accumulator fuel injection device for pressurizing fuel having a flow rate per unit time of 500 to 1,500 litters per hour up to 50 MPa or more.

Using such an accumulator fuel injection device allows the pressurization of the fuel having a large flow rate easily. Therefore, the fuel injection at multi-stage pressures can be easily implemented and thus the combustion efficiency in the fuel injection system can be raised.

[10] In addition, another embodiment of the present invention is a tappet structure having a roller and a roller body, wherein the roller body is provided with a pass-trough hole for allowing the passage of a lubricant or a fuel for lubrication such that the pass-through hole penetrates from the upper surface portion to non-roller portion of the roller body, for example opens in the side surface portion thereof.

That is, when the plunger rises for pressurizing the fuel, the lubricant or the fuel for lubrication in the spring-holding chamber can be transferred quickly and smoothly through the pass-through hole which cannot be closed by the roller. On the other hand, when the plunger moves down to inhale fuel, the lubricant or the fuel for lubrication in the cam chamber can be transferred quickly and smoothly to the spring-holding chamber through the pass-through hole formed in the roller body.

Therefore, such a tappet structure body allows the cam and the plunger to be driven at high speed when the tappet structure body is used in the fuel supply pump. For instance, when the cam is driven quickly at a rotational frequency of 1,500 rpm or more, the lubricant or the fuel for lubrication inhibits the high-speed movement of the cam and the plunger less frequently than before.

As a result, the lubricant or the fuel for lubrication inhibits the high-speed movements of the cam and the plunger less frequently than before, resulting in less exposure to heat generated by friction with a cam shaft.

BEST MODE FOR CARRYING OUT THE INVENTION

First Embodiment

Figure 1:
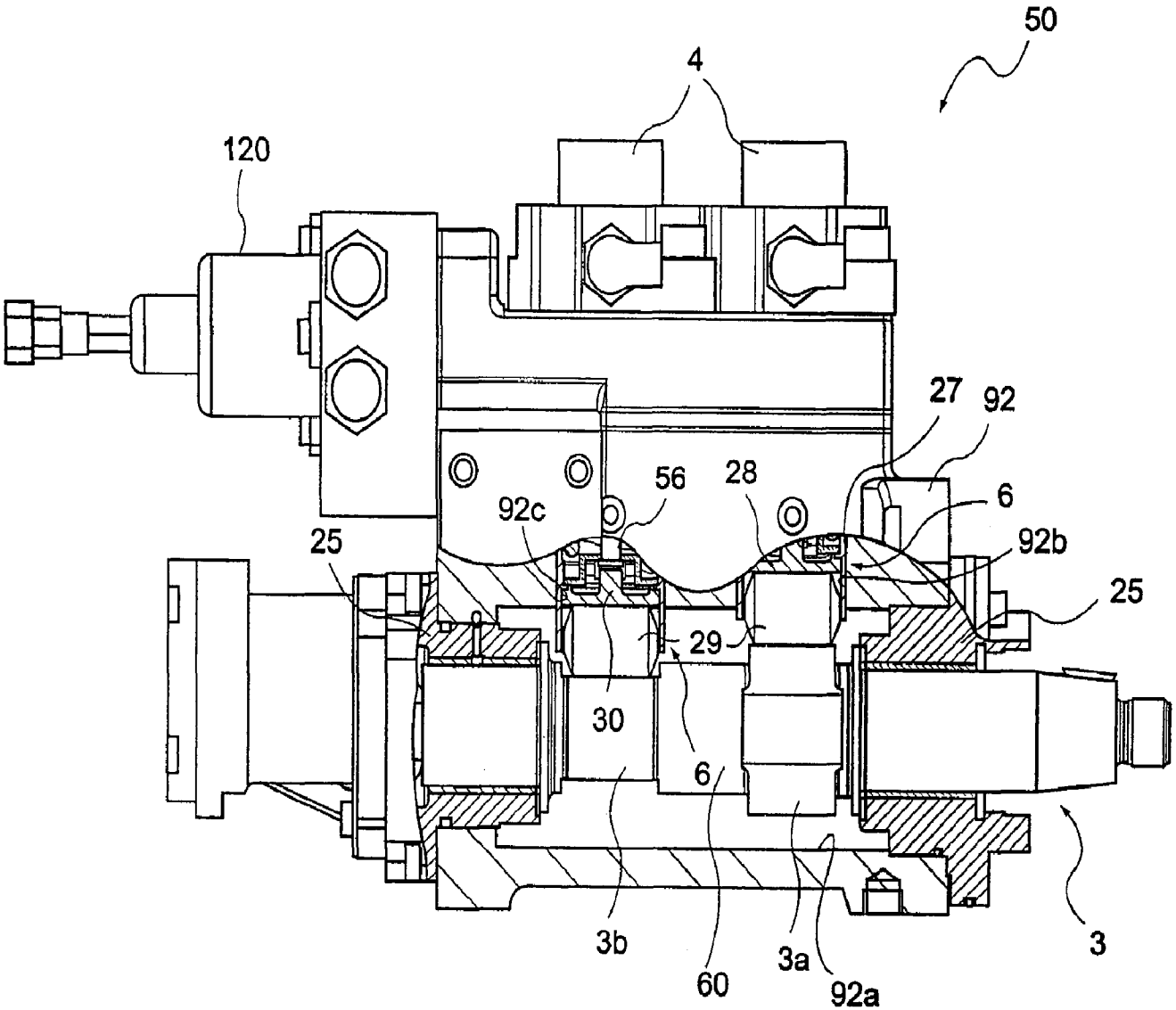
FIG. 1 is a side-view of the fuel supply pump of the present invention with a portion partly broken away.
Figure 2:
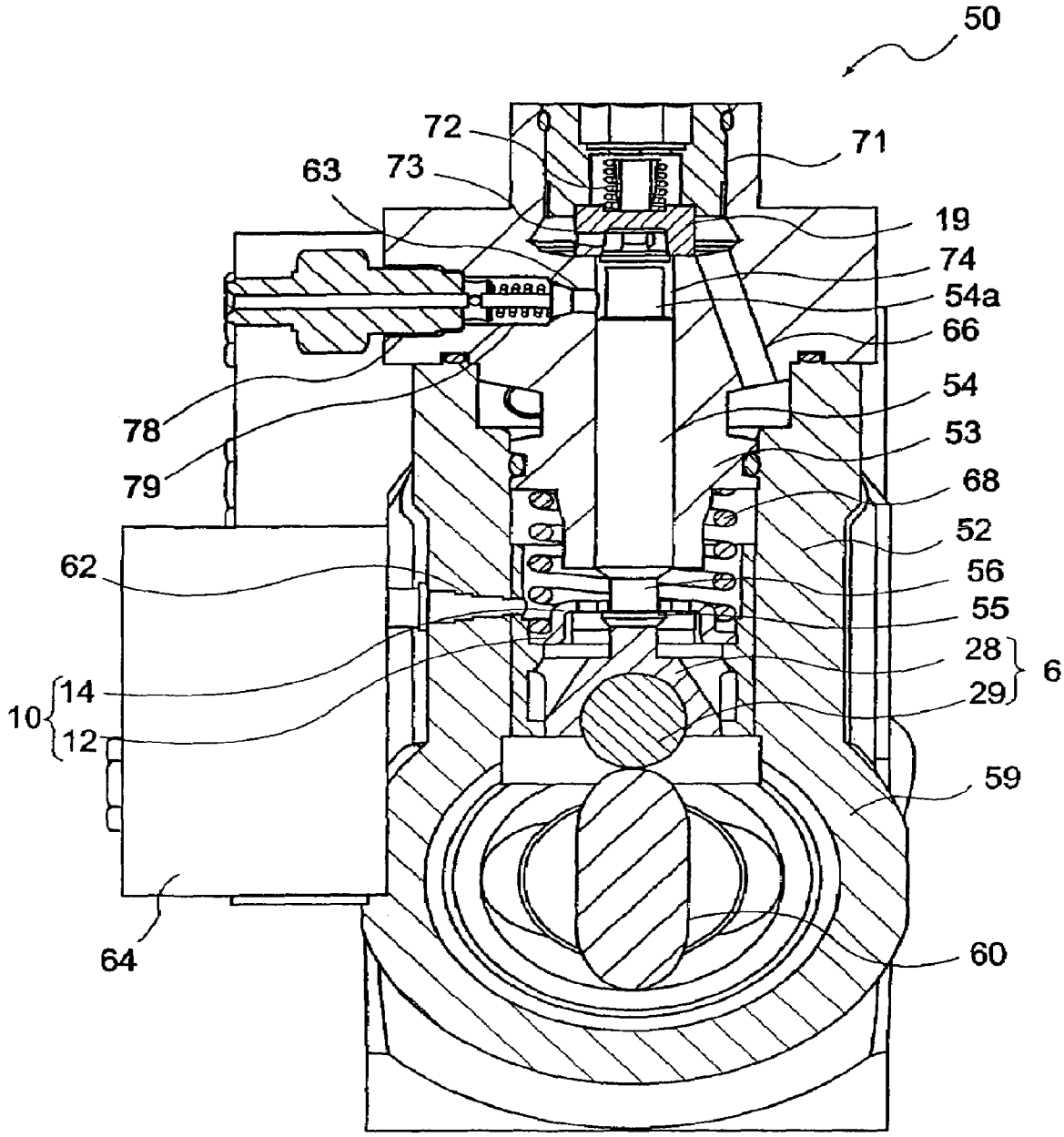
FIG. 2 is a cross-sectional view of the fuel supply pump of the present invention.

As shown in FIG. 1 and FIG. 2, a first embodiment of the present invention is a fuel supply pump 50 equipped with a specific spring sheet 10 and a tappet structure body 6. The spring sheet 10 comprises: a spring holding portion 12 for retaining a spring 68 used for pulling a plunger 54 of a fuel supply pump 50; and a plunger mounting portion 14 for mounting the tip portion 55 of the plunger 54 thereon. In addition, a plurality of pass-through holes 16 is formed around the plunger mounting portion 14. Furthermore, the tappet structure body 6 comprises a roller 29 and a roller body 28. In addition, a plurality of pass-through holes 30*b* is formed in the roller body 28. There, the spring sheet 10 and the tappet structure body 6 work together to make a penetration portion for allowing the passage of a lubricant or a fuel for lubrication in the present fuel supply pump 50.

Hereinafter, the fuel supply pump 50 will be described more concretely by way of individually describing its structural components.

1. Basic Configuration of Fuel Supply Pump

For example, the configuration of the fuel supply pump is, but not specifically limited to, preferably one having a fuel supply pump 50 shown in FIGS. 1 and 2. That is, the fuel supply pump 50 is preferably constructed of a pump housing 52, a barrel (cylinder) 53, a plunger 54, a spring sheet 10, a tappet structure body 6, and a cam 60.

Furthermore, the plunger 54 slides reciprocally along the inside of the barrel 53 in the pump housing 52 in response to the rotary movement of the cam 60 to form a fuel compression chamber 74 for pressurizing fuel introduced therein.

Therefore, the fuel fed under pressure from a feed pump 64 is effectively pressurized by the plunger 54 in the fuel compression chamber 74, resulting in high pressure fuel.

In this example of the fuel supply pump 50, for example, two sets of the barrel (cylinder) 53 and the plunger 54 are installed in the pump housing 52. For pressurizing a much more amount of fuel, two or more sets are preferably used.

(1) Pump Housing

The pump housing 52 is, as exemplified in FIG. 1 and FIG. 2, an enclosure for housing the barrel (cylinder) 53, the plunger 54, the tappet structure body 6, and the cam 60.

Figure 3:
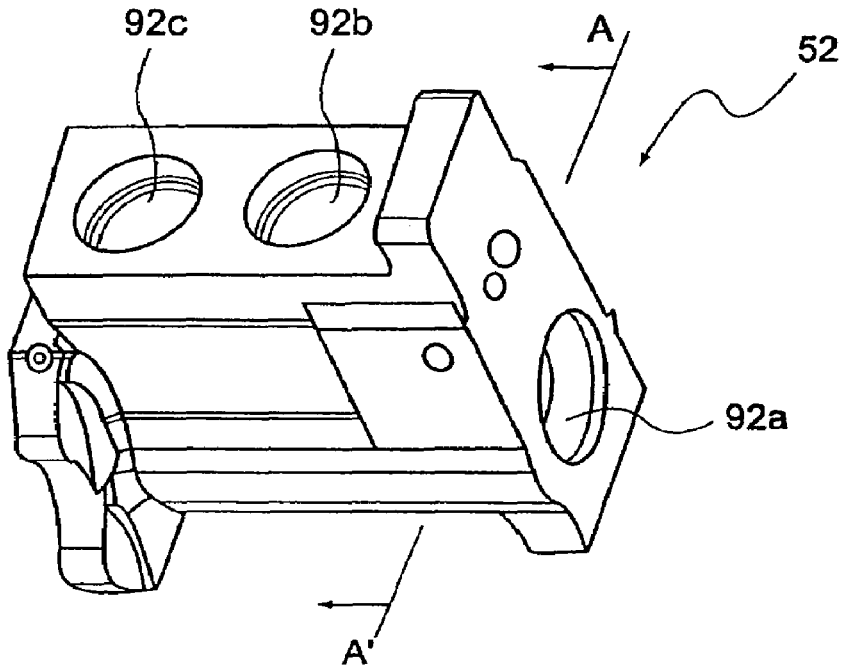
FIG. 3 is a diagram for illustrating a housing, where (a) and (b) are perspective and cross-sectional views thereof, respectively.
Figure 3:
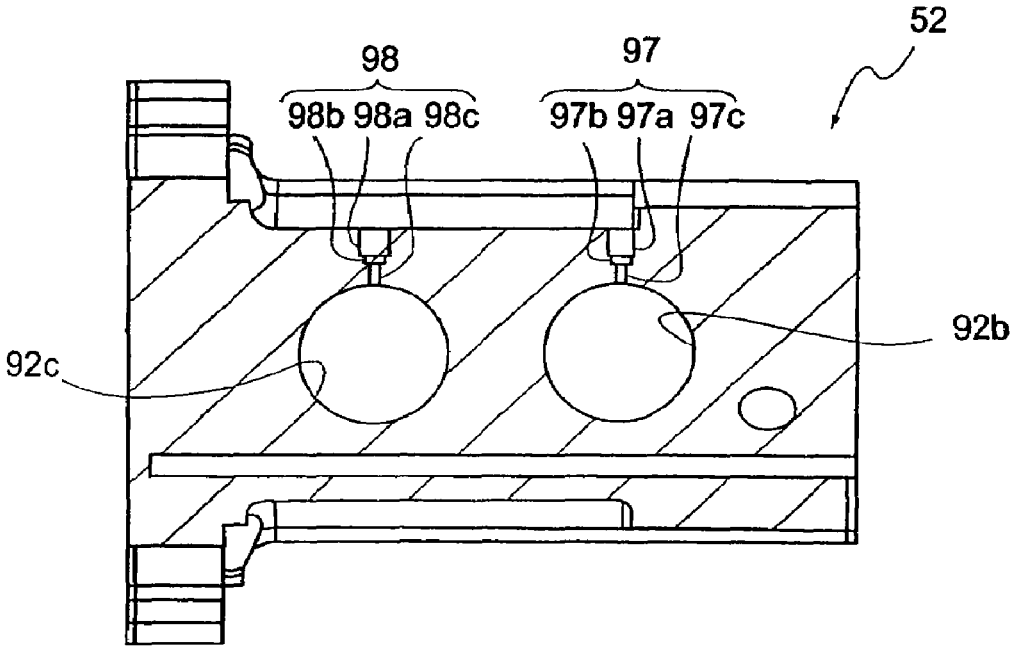

Therefore, as exemplified in FIGS. 3(*a*) and 3(*b*), preferably, the pump housing 52 has a shaft-inserting hole 92*a* opened from side to side in the horizontal direction and a cylindrical spaces 92*b*, 92*c* opened from end to end in the vertical direction.

Furthermore, as shown in FIG. 3(*b*), the pump housing 52 is preferably provided with through-holes 97, 98 opened in the lateral directions of the cylindrical spaces 92*b*, 92*c*, respectively. Specifically, each of the through-holes 97, 98 is provided as an assembly of three hole portions (large, middle, and small holes) 97*a*-97*c*, 98*a*-98*d* with different pore sizes, concentrically arranged in a stepwise pattern. The tip portions of guide pins are press-inserted into the hole portion 97*a*, 98*a* to ensure high-precision positioning of the guide pins. In addition, the hole portions 97*b*, 98*b* have their own functions of introducing the tip portions of the guide pins into the hole portions 97*c*, 98*c* to press-insert the tip portions of the guide pin into the hole portions 97*c* or 98*c*, respectively. In addition, the hole portions 97*a*, 98*a* are preferably formed of threaded portions such that the guide pins can be threadably fit into the hole portions 97*a*, 98*a* to press-insert the dip portions of the guide pins into the hole portions 97*a*, 98*a*, respectively.

(2) Plunger Barrel

A plunger barrel 53 is, as exemplified in FIG. 1 and FIG. 2, an enclosure for supporting the plunger 54 and constitutes a part of a fuel compression chamber (pump chamber) 74 for pressurizing a large amount of fuel at high-pressures by the plunger 54. Therefore, the plunger barrel 53 is preferably attached to the upper opening portion of each of the cylindrical spaces 92*b*, 92*c* in the pump housing 52.

Furthermore, when the fuel supply pumps to be mounted on the plunger barrel are of inline and radial types, the conformation of the plunger barrel can be suitably changed so as to correspond to the respective types.

(3) Plunger

As exemplified in FIG. 1 and FIG. 2, the plunger 54 is a principle structural component for pressurizing fuel at high pressures in the fuel compression chamber 74 formed in the plunger barrel 53. Therefore, the plunger 54 is preferably arranged so as to be capable of lifting and lowering movements in the plunger barrel 53 attached in each of the cylindrical spaces 92*b*, 92*c* formed in the pump housing 52 lifting and lower movement.

Figure 4:
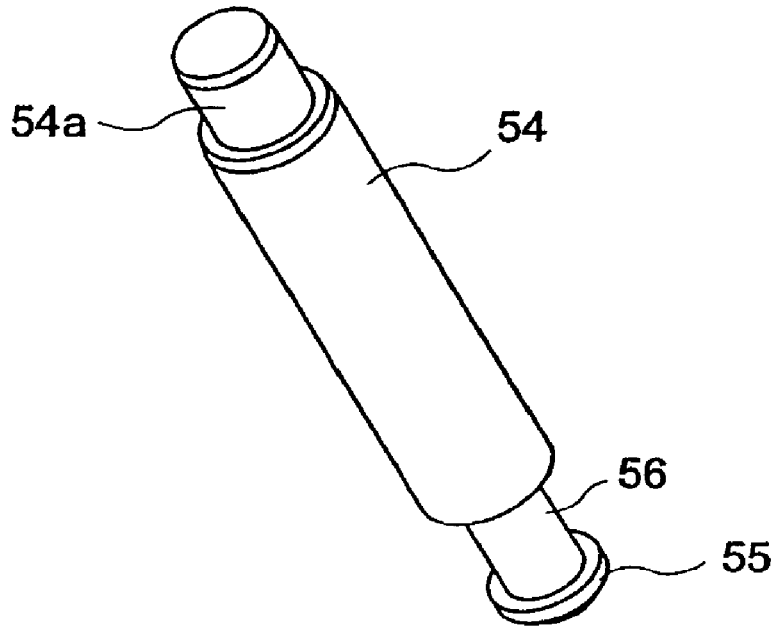
FIG. 4 is a diagram for illustrating a plunger, where (a) and (b) are perspective and cross-sectional views thereof, respectively.
Figure 4:
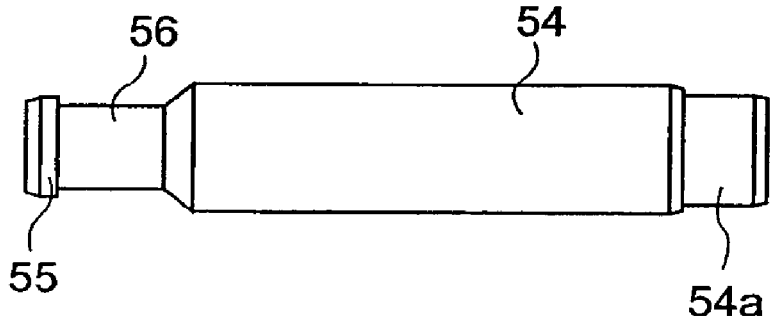
Figure 5:
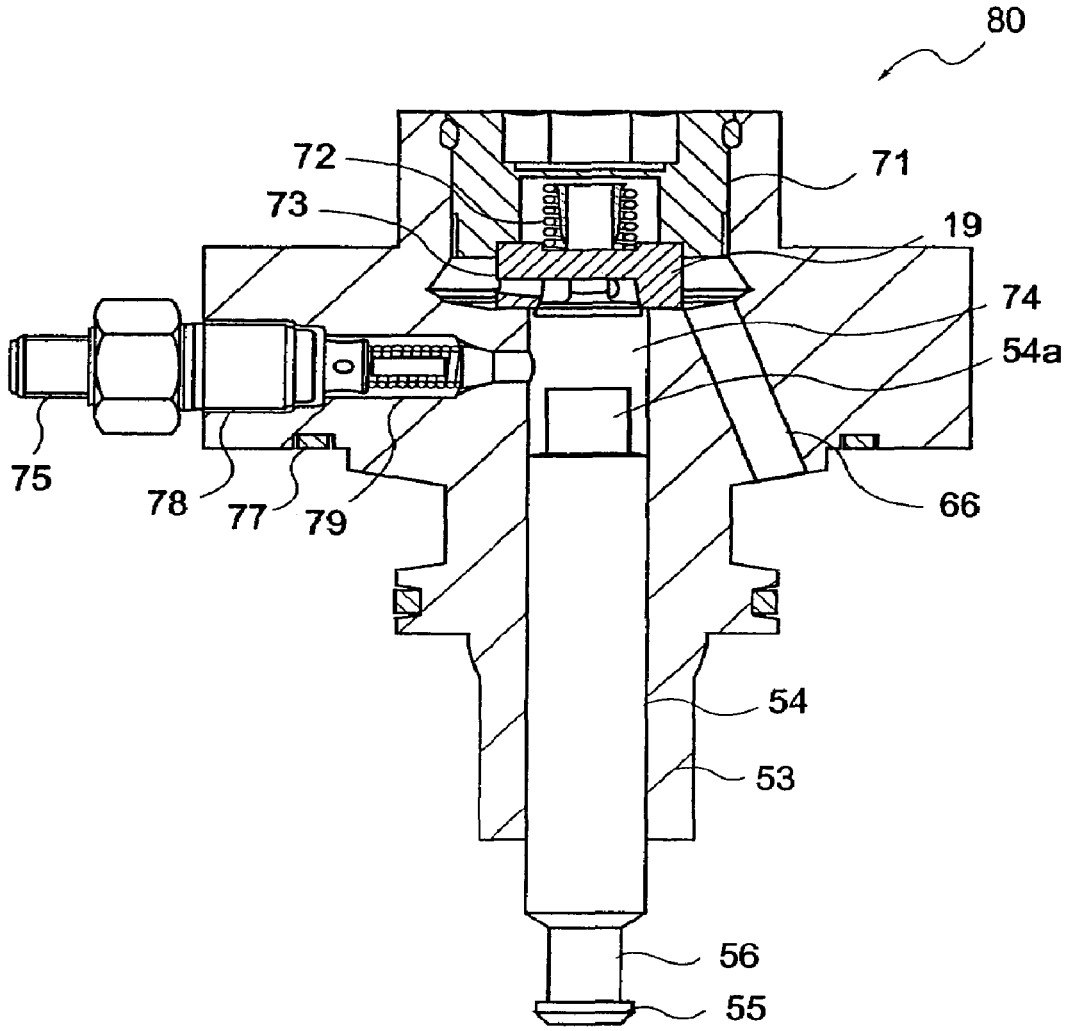
FIG. 5 is a diagram provided for the explanations of a fuel inlet valve and a fuel outlet valve.

In addition, as shown in FIG. 4 and FIG. 5, the plunger 54 is preferably provided with a pressure portion 54*a* for allowing the plunger 54 to be introduced into or pulled out of the inside of the fuel compression chamber 74. The pressure portion 54*a* is designed such that the pressure portion 54*a* has a diameter smaller than the diameter of the plunger barrel 53. Thus, a gap is preferably formed between the pressure portion 54*a* and a discharge valve 79 when the pressure portion 54*a* moves to the top dead center. This is because that the plunger 54 is driven at high speed to smoothly feed fuel to a common rail under pressure without allowing the pressure portion 54*a* to occlude the inlet of the discharge valve 79 even after pressurizing a large amount of fuel.

Furthermore, the plunger 54 is preferably formed in the shape of a round bar as a whole and provided with a collar portion 55 on its opposite end with respect to the pressure portion 54*a* to allow the plunger 54 to be smoothly driven at high speed in the plunger barrel 53. That is, it is preferable that the collar part 55 for locking is integrally formed on the external peripheral surface of the tip portion (lower end portion) of the cylindrical plunger 54. This is because that such a configuration of the plunger 54 can be easily and positively fixed in the opening portion 15 formed in the plunger mounting portion 14.

Furthermore, as shown in FIG. 2, the plunger 54 is preferably constructed such that the plunger 54 is always forced to move toward the cam by a spring 68 for returning the plunger and moves upward in response to the rotary movement of the cam 60 to pressurize fuel in the fuel compression chamber 74.

Furthermore, in the fuel supply pump of the first embodiment, it is preferable to pressurize a large amount of fuel by driving the cam and the plunger at high speed. Specifically, the rotation frequencies of the cam and the plunger are preferably in the range of 1,500 to 4,000 rpm. In addition, considering a gear ratio, the rotation frequencies of the cam and the plunger are preferably in the range of 1 to 5 times higher than the rotation frequency of an engine.

(4) Fuel Compression Chamber

As shown in FIG. 2 and FIG. 5, the fuel compression chamber 74 is a small chamber in the plunger barrel 53, which is formed by a combination of the plunger barrel 53 and the plunger 54. Thus, in the fuel compression chamber 74, the fuel quantitatively introduced into the fuel compression chamber 74 through a fuel supply valve 73 can be pressurized efficiently and massively by driving the plunger 54 at high speed. Furthermore, even though the plunger 54 is driven at high speed as described above, for preventing a lubricant or a fuel for lubrication from inhibiting a high speed movement of the plunger 54, it is preferable that a spring sheet and a roller body described latter are provided with their respective pass-through holes and the corresponding pass-through holes are communicated with each other.

Figure 11:
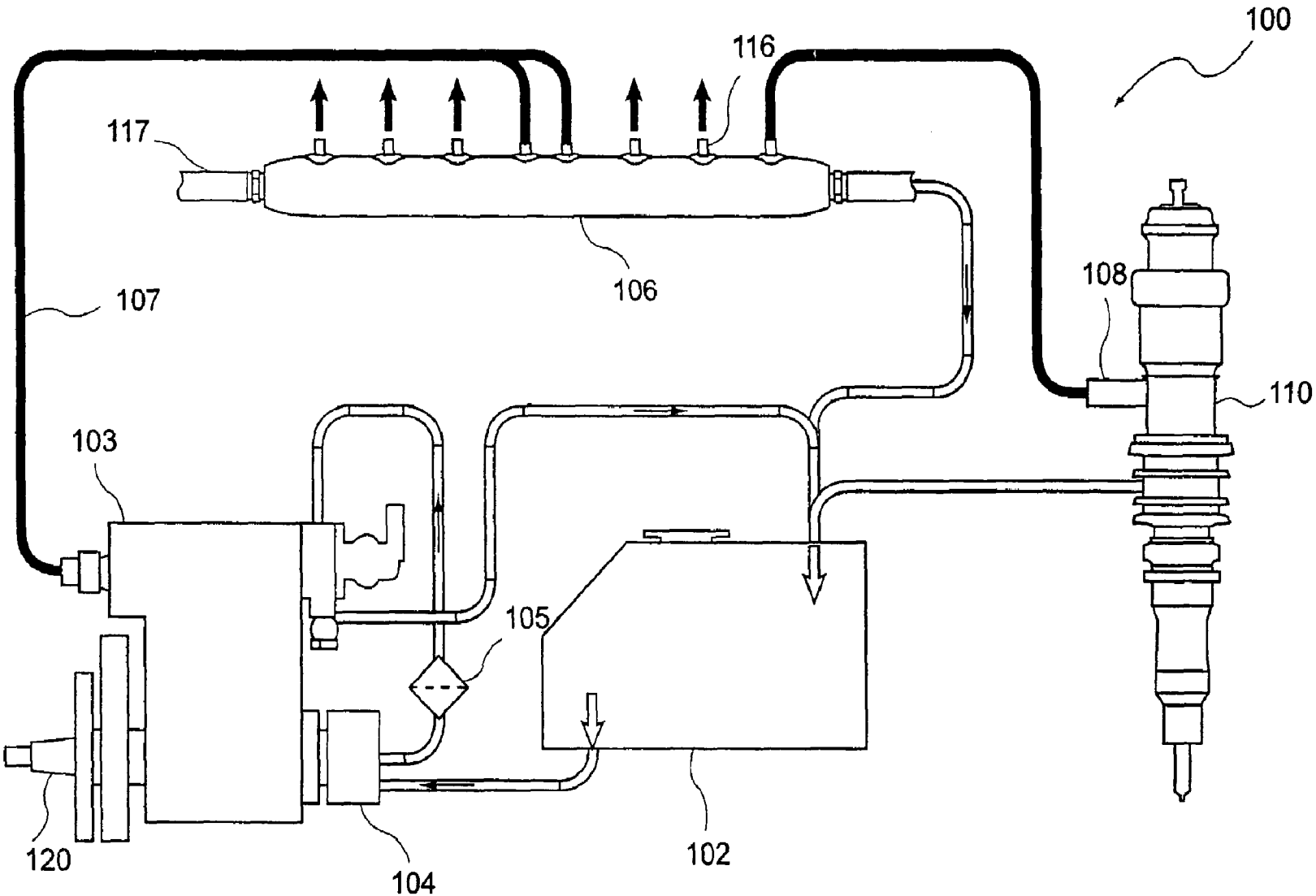
FIG. 11 is a diagram for illustrating the system of an accumulator fuel injection device (APCRS).

On the other hand, after completion of pressurization with the plunger 54, the pressurized fuel is supplied to a common rail 106 shown in FIG. 11 through the fuel discharge valve 79.

(5) Spring Sheet

Figure 6:
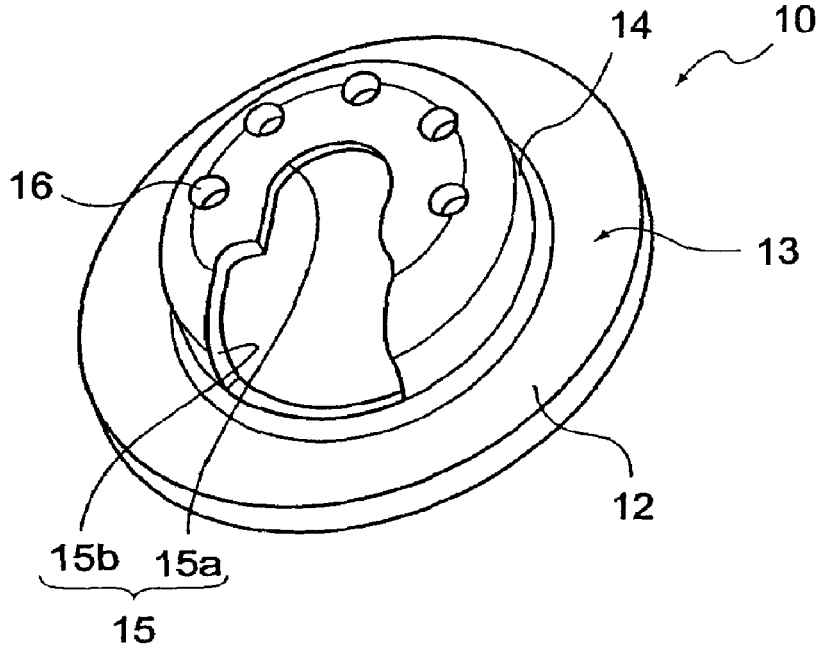
FIG. 6 is a perspective view of a spring sheet.
Figure 7:
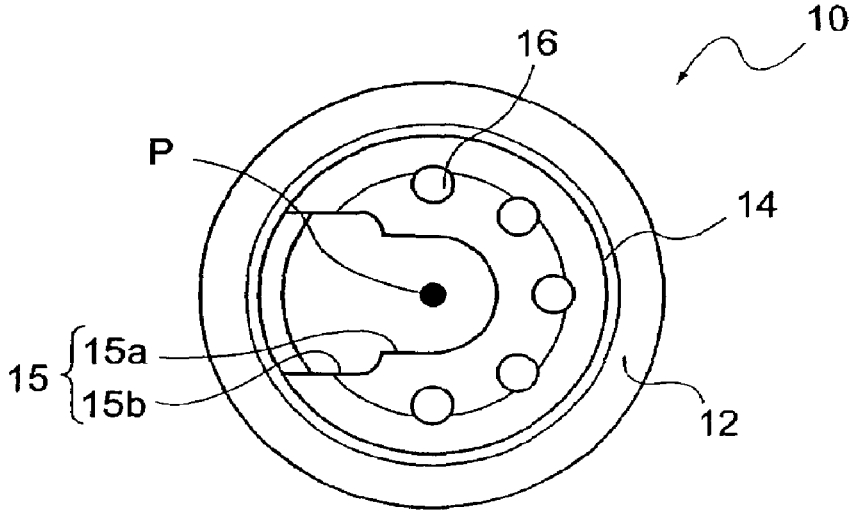
FIG. 7 is a diagram of the spring sheet, where (a) and (b) are plane and cross-sectional views thereof, respectively.
Figure 7:
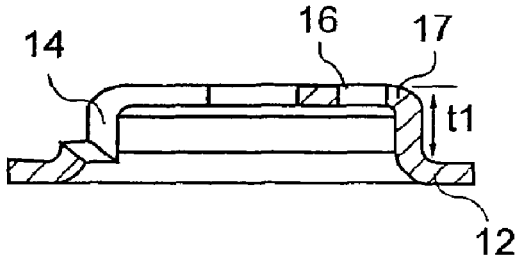

As exemplified in FIG. 6 and FIGS. 7(*a*) and 7(*b*), the spring sheet 10 comprises a spring holding portion 12 for retaining a spring to be used at the time of pulling down the plunger of the fuel supply pump and a plunger mounting portion 14 for catching the plunger. Preferably, pass-through holes 16 for allowing passage of a lubricant or a fuel for lubrication are formed around the plunger mounting portion 14.

(5)-1 Spring Holding Portion

The configuration of a spring holding portion 12 is not specifically limited to as far as a spring used for pulling down the plunger of the fuel supply pump can be easily arranged. As shown in FIGS. 6 and 7, however, it may be of a disk shape or a planner body with portions partially protruded in the circumferential direction.

Alternatively, but not shown in the figure, a groove or a hook may be preferably formed in or provided on part of the spring holding portion to embed or catch part of the spring.

For the arrangement of the spring holding portion 12, as shown in FIG. 6 and FIGS. 7(*a*) and 7(*b*), it is preferably provided around the latter-described plunger mounting portion 14.

The reason of such an arrangement is that the spring can be easily fixed and precisely disposed in place by means of bringing a coil spring (not shown) used for pulling down the plunger into contact with the surface 13 of the spring holding portion 12.

(5)-2 Plunger Mounting Portion

The configuration of a plunger mounting portion is not limited to particular one as far as it is configured to easily catch the plunger and pull it down. As shown in FIG. 7(*a*), for example, the plunger mounting portion is preferably a combination of a comparatively large insert hole 15*b* in which the tip portion of the plunger can be laterally inserted by sliding; a comparatively small central hole 15*a* for catching the tip portion of the plunger.

That is, it is preferable that the width of the insert hole 15*b* of the opening 15 is larger than the diameter of the central hole 15*a* of the opening 15.

Figure 8:
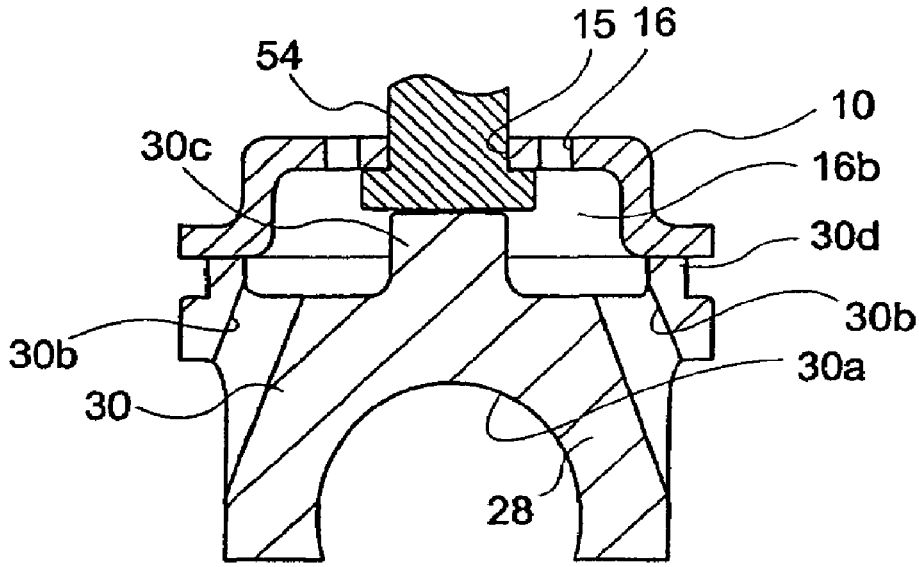
FIG. 8 is a diagram for illustrating the mounting structure of the plunger, where (a) to (c) are cross-sectional views of different configurations thereof, respectively.
Figure 8:
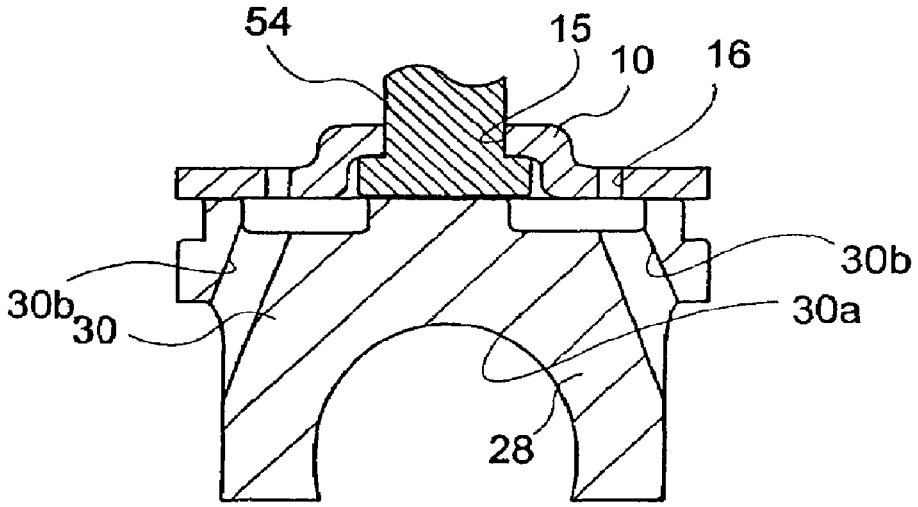
Figure 8:
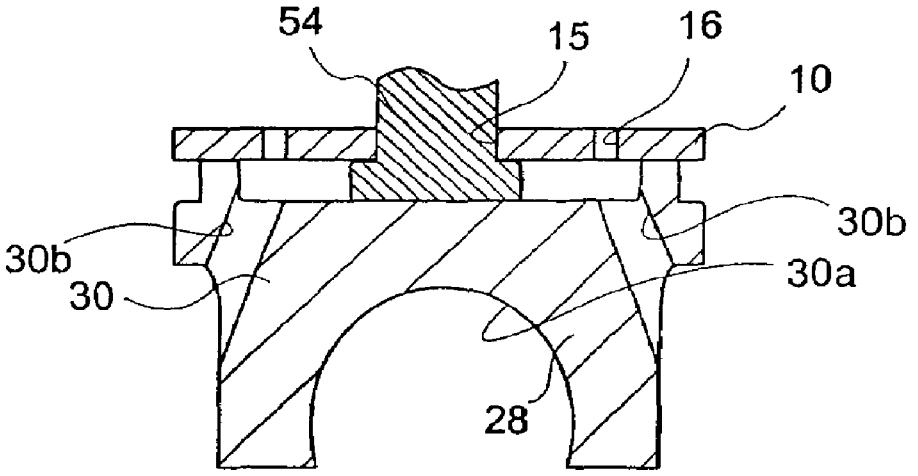

This is because that such a configuration of the opening 15 allows the spring sheet and the plunger to easily catch one another while easily centering them together without using any specific additional fixing device. Therefore, in the fuel supply pump, even at the time of drying the plunger at high speed, the displacement between the tappet structure body and the plunger can be lowered. As the plunger mounting portion 14 is constructed as above, as shown in FIGS. 8(*a*) to (*c*), a collar portion formed on the tip portion of the plunger 54 is allowed to pass through the insert hole 15*b* of the opening 15. Then, the collar portion is allowed to catch the rear surface of the plunger mounting portion 14 in the central hole 15*a* of the opening 15 to prevent them from pulling out.

Furthermore, the plunger mounting portion may be preferably configured as modified examples shown in FIGS. 8(*a*) to 8(*c*).

Here, in FIG. 8(*a*), there is shown an example in which a plunger mounting portion 14 is shaped like a dish to form a fuel reserving portion 16*b* in the inner area of the spring holding portion 12. According to such a configuration of the plunger mounting portion, as described latter, a step 17 can be easily formed between the spring holding portion 12 and the side surface of the plunger mounting portion 14. Thus, even the pass-through hole 16 of the spring sheet 10 is slightly displaced from the pass-through hole 30*b* of the roller body 28, a fuel reserving portion is formed between them. Even in the case of driving the plunger at high speed, a lubricant or a fuel for lubrication can be freely fed therethrough. Therefore, the high speed driving of the plunger becomes less inhibited and exerts predetermined lubrication effects on the respective points.

Furthermore, in FIG. 8(*b*), there is shown another example where a plunger mounting portion 14 is configured enough to easily mount the plunger thereon and formed in the inner region of the spring holding portion 12 without forming any fuel reserving portion 16*b* therein. As constructed above, the spring sheet can be thinned. Therefore, the spring sheet can be handled and processed without difficulty.

Furthermore, FIG. 8(*c*) shows another example in which a plunger mounting portion 14 is formed such that it extends directly to the inner area of the spring holding portion 12. Such a configuration of the plunger mounting portion 14 allows both the spring holding portion 12 and the plunger mounting portion 14 to be substantially formed into flat. Therefore, the spring sheet can be handled and processed without difficulty.

By the way, in the examples shown in FIGS. 8(*b*) and 8(*c*), the pass-through hole 16 of the spring sheet 10 and the pass-through hole 30*b* of the roller body 28 are aligned with each other to make a communication between them. Thus, even in the case of driving the plunger at high speed, a lubricant or a fuel for lubrication can be freely fed therethrough. Therefore, the high speed driving of the plunger becomes less inhibited and exerts predetermined lubrication effects on the respective points.

Furthermore, regarding to the arrangement of the plunger mounting portion 14, as shown in FIG. 6 and FIGS. 7(*a*) and 7(*b*), it is preferable to form the plunger mounting portion 14 in the inner area of the spring holding portion 12.

This is because, as constructed above, the spring holding portion 12 is allowed, for example, to retain a cylindrical spring. In addition, in the inner area of the spring, the plunger can be caught in the inner area of the spring and easily centered to allow the plunger to drive at high speed.

Furthermore, as shown in FIG. 7(*b*), the height of the plunger mounting portion 14 is adjusted to make a step 17 between the spring holding portion 12 and the side surface of the plunger mounting portion 14. Here, in FIG. 7(*b*), the height of the step 17 is represented by the symbol t1.

This is because that such a step allows the spring to be precisely arranged in place and the tip portion of the plunger of the fuel supply pump can be easily housed.

Specifically, it is preferable that the step has a height (t1) of 1 mm or more.

(5)-3 Pass-Through Hole

The configuration and number of pass-through holes 16 formed around the plunger mounting portion 14 are not specifically limited. Preferably, however, circular pass-through holes are formed with a limited number of 1 to 20.

This is because, even only one pass-through hole is formed, consideration of the size and arrangement of such a hole may allow the formation of a penetration portion to permit a lubricant or a fuel for lubrication to efficiently pass through a cam chamber. On the other hand, when the number of the pass-through holes exceeds 20, it may become difficult to align or form these holes on the spring sheet.

Therefore, the number of the pass-through holes is preferably in the range of 2 to 15, more preferably in the range of 3 to 10.

Here, it is preferable that the pass-through hole is substantially shaped in a circle, or it may be preferably shaped in another form such as an oval, square, irregular, or groove form.

Furthermore, as shown in FIG. 6 and FIG. 7(*a*), the pass-through holes 16 are preferably arranged around the plunger mounting portion 14 in a radial pattern or in a semi-radial pattern. The example shown in FIG. 6 and FIG. 7(*a*), there are five pass-through holes 16 arranged in a semi-radial pattern with respect to the central point P of the plunger mounting portion 14.

This is because that the pass-through holes uniformly arranged in the spring sheet allow quick passage of a lubricant or a lubricant. In addition, such an arrangement of pass-through holes less restricts the mounting location of the plunger mounting portion.

However, as shown in FIG. 7(*a*), when the opening 15 for allowing the tip portion of the plunger to be laterally inserted by sliding is formed, the pass-through holes 16 are preferably arranged in a semi-radial pattern while staying out of the opening 15.

Furthermore, when the pass-through holes 16 exemplified in FIG. 6 and FIG. 7(*a*) is substantially in the shape of a circle, it is preferable that each of the pass-through holes has a diameter of 0.5 to 12 mm.

This is because that, when the diameter of the pass-though hole is less than 0.5 mm, it may be difficult to allow quick passage of a lubricant or a fuel for lubrication. Therefore, for example, it may be difficult to attain high pressure conditions of 50 MPa or more in an accumulator fuel injection device useful in conjunction with a piston amplifier (amplifying piston) coupled with the fuel supply pump.

On the other hand, another reason is that the mechanical strength of the spring sheet may fall or the durability thereof may fall when the diameter of the pass-through hole exceeds 12 mm.

Therefore, the diameter of the pass-through hole is more preferably in the range of 1 to 10 mm, still more preferably in the range of 1.5 to 6 mm.

Preferably, furthermore, plural pass-through holes may have their respective diameters different from each other. This is because the pass-through holes can be provided as a mixture of those having comparatively large diameters and those having comparatively small diameters. Namely, the larger holes allow a lubricant or a fuel for lubrication to quickly pass therethrough and the smaller holes allow detailed controls on the amount or rate of a lubricant or a fuel for lubrication passed while reducing restraints on the formation or arrangement of these holes.

Therefore, as an example, the pass-through holes are preferably provided as a mixture of those having comparatively large diameters of 2.5 mm or more and those having comparatively small diameters of less than 2.5 mm.

Furthermore, it is also preferable that the pass-through holes having comparatively large diameters of 2.5 mm or more are formed in the plunger mounting portion and those having comparatively small diameters of less than 2.5 mm are formed in the spring holding portion.

(6) Tappet Structure Body

The configuration of a tappet structure body is not limited to a specific one as far as it cooperates with the spring sheet to form a penetration portion. For example, however, it may be constructed of the same constituents as those of the second embodiment described latter. Therefore, detained description thereof will be omitted.

(7) Cam

As shown in FIG. 1 and FIG. 2, a cam 60 is a main element for converting the rotary movement of a motor into the vertical motion of the plunger 54 through the tappet structure body 6. Therefore, preferably, the cam 60 is inserted and held rotatably in a shaft-inserting hole 92*a* via a bearing body. Then, it is constructed so as to be revolved by driving a diesel engine (cam shaft 3).

The outer peripheral surface of the cam 60 is preferably integrally provided with two cam portions 3*a*, 3*b* in parallel with each other with a predetermined distance in the axial direction and located below the cylindrical spaces 92*b*, 92*c* of the pump housing 52.

Here, these cam portions 3*a*, 3*b* are preferably arranged in parallel with each other with a predetermined distance oppositely in the circumferential direction.

(8) Fuel Inlet Valve and Fuel Outlet Valve

Figure 9:
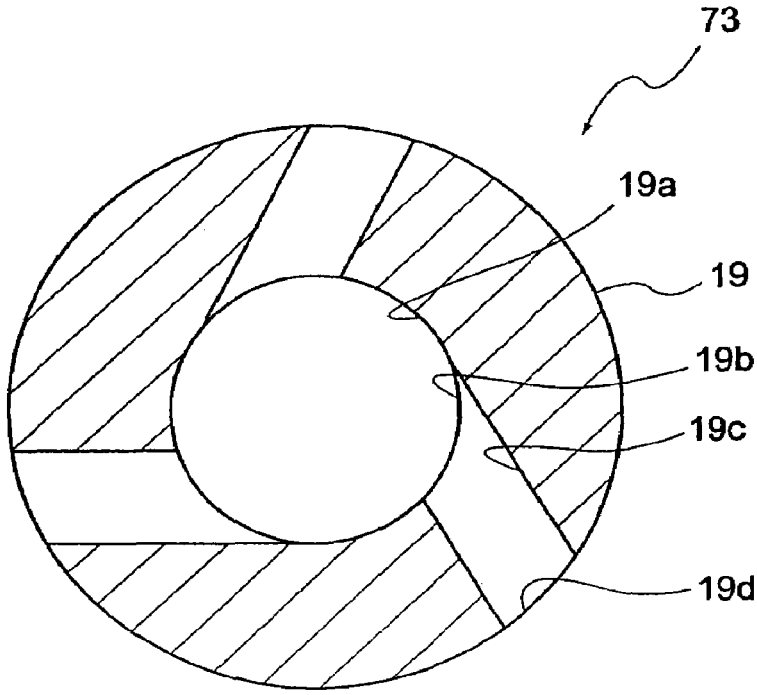
FIG. 9 is a diagram for illustrating the fuel inlet valve, where (a) and (b) are different cross-sectional views thereof, respectively.
Figure 9:
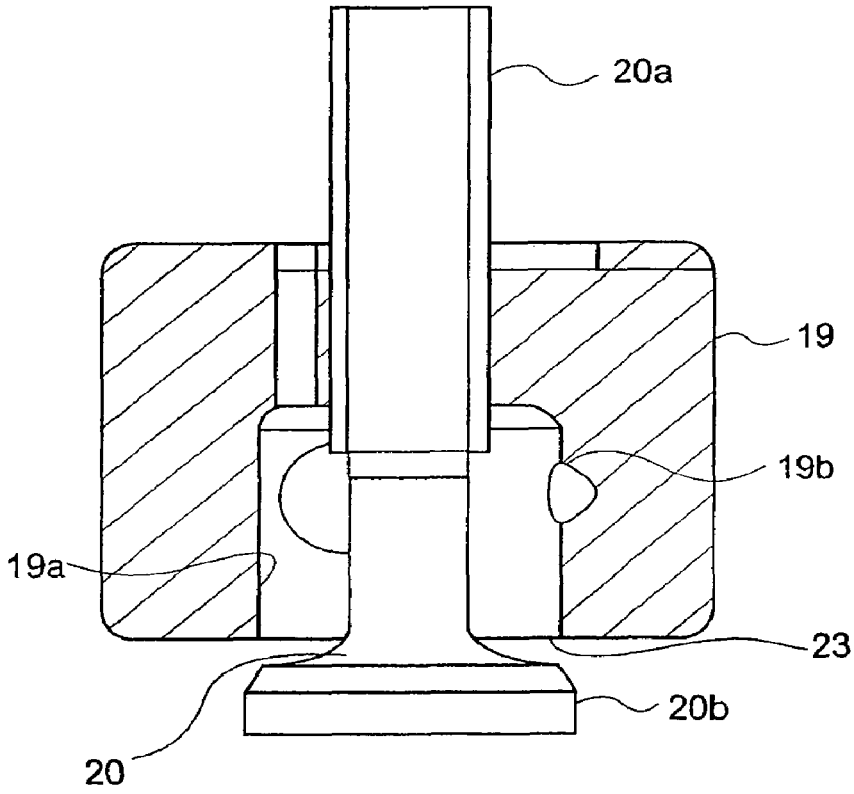
Figure 10:
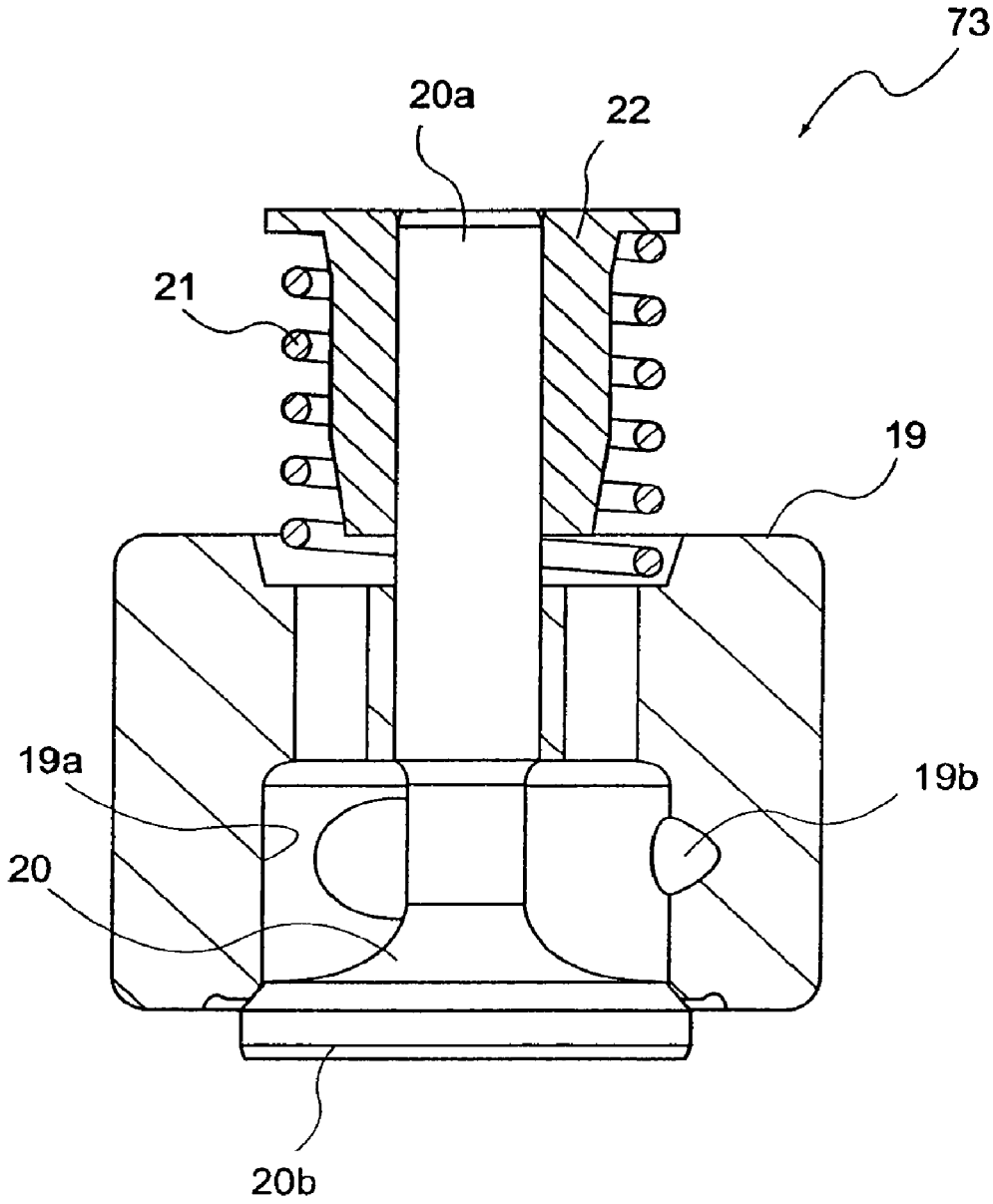
FIG. 10 is a cross-sectional view of the fuel inlet valve.

Preferably, a fuel inlet valve and a fuel outlet valve are arranged as exemplified in FIG. 5 and constituted as exemplified in FIGS. 9 to 10.

In other words, the fuel inlet valve 73 is preferably constructed of a valve main body 19 and a valve body 20 having a collar portion 20*b* on its tip portion. Besides, as shown in FIG. 10, the valve main body 19 is preferably provided with a cylindrical fuel inlet chamber 19*a* opened downward and a fuel inlet hole 19*b* for feeding fuel into the fuel inlet chamber 19*a*.

Furthermore, preferably, the fuel outlet valve 79 comprises a valve body and is housed in part of the pump housing. Then, preferably, the valve body is always energized by a spring in the valve-closing direction to supply a pressurized fuel to a common rail by opening and closing the valve.

Furthermore, as shown in FIG. 9, each of the fuel inlet valve 73 and the fuel outlet valve 79 comprises the valve main body 19, the valve body 20 movably attached in the inside of the valve main body 19, the fuel inlet chamber 19*a* provided in the inside of the valve main body 19, the fuel inlet hole 19*b*, the sheet portion 23 mutually contacted with the valve body 20 and part of the valve main body 19. Preferably, two or more fuel inlet holes 19*b* are formed and arranged in a non-radial pattern with respect to the fuel inlet chamber 19*a*.

This is because that such a fuel inlet valve supplies the fuel supply pump with fuel, for example, even at a flow rate of approximately 500 to 1,500 litters per hours quickly and quantitatively.

Likewise, the fuel outlet valve as constructed above also supplies the common rail with fuel, for example, even at a flow rate of approximately 500 to 1,500 litters per hours quickly and quantitatively.

(9) Lubrication System

Furthermore, a lubrication system of the fuel supply pump preferably employs, but not specifically limited to, a fuel lubrication system that utilizes part of a fuel oil as a lubrication component (fuel for lubrication).

This is because, when the cam and the plunger are driven at high speed for pressurizing a large amount of fuel, the lubrication component existed in the spring-holding chamber may tend to be mixed with part of the fuel leaked from a fuel-pressurizing chamber even the sealing property of the chamber is enhanced. In other words, even though the fuel pressurized in large amounts and the fuel for lubrication provided as a lubrication component are partially mixed together, employing the fuel lubrication system prevents the lubrication component from becoming wax while keeping the ability of emission gas purification because they have the same composition.

2. Amplified Piston Common Rail System

Furthermore, the fuel supply pump of the first embodiment is preferably a part of an amplified mechanical common rail system 100 using a mechanical pressure amplifying system such as piston.

That is, as shown in FIG. 11, the fuel supply pump 103 is preferably constructed of a fuel tank 102, a feed pump (low pressure pump) 104 for supplying the fuel from the fuel tank 102, a fuel supply pump (high pressure pump) 103, a common rail 106 provided as a pressure accumulator for pressure-accumulation of the fuel fed under pressure from the fuel supply pump 103, a piston amplifier 108 (amplifying piston), and a fuel injection system 110.

(1) Fuel Tank

The capacity and form of a fuel tank 102 exemplified in FIG. 11 are preferably defined in consideration of, for example, the circulation of fuel at a flow rate of approximately 500 to 1,500 litters per hour.

(2) Feed Pump, Proportional Control Valve, and Fuel Supply Pump

The feed pump 104 is, as shown in FIG. 11, provided for feeding fuel (diesel oil) in the fuel tank 102 to the fuel supply pump 103 under pressure. It is preferable that a filter 105 is placed between the feed pump 104 and the fuel supply pump 103. Preferably, for example, the feed pump 104 has a gear pump structure mounted on the end of the cam such that the feed pump 104 can be driven by directly connecting with the axis of the cam or through an appropriate gear ratio.

Figure 12:
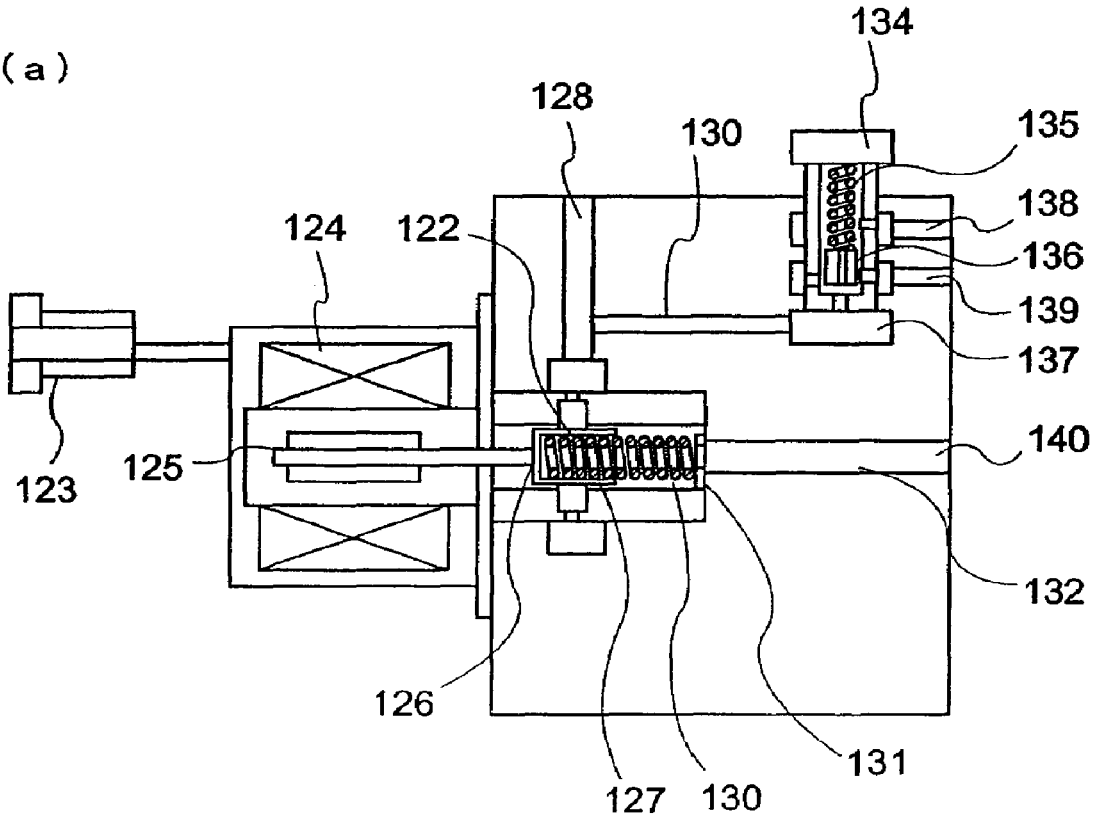
FIG. 12 is a diagram for illustrating the configuration of a proportional control valve.
Figure 12:
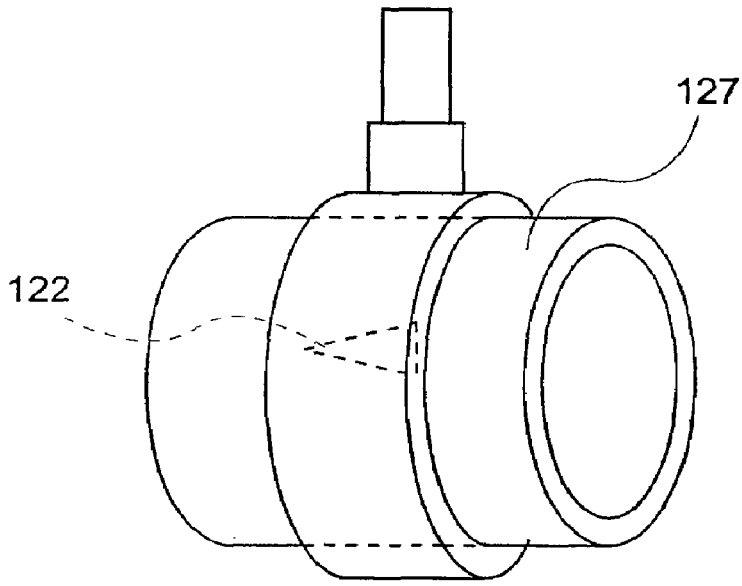

Furthermore, the fuel fed under pressure from the feed pump 104 through the filter 105 is preferably supplied to the fuel supply pump 103 through a proportional control valve (FMU) 120 for adjusting the amount of fuel injected as shown in FIG. 12. Preferably, the proportional control valve 120 controls the amount of current passing through a coil 124 under the control of an electronic control unit (ECU) described later to proportionally adjust the position of an anchor 125. That is, the position of a piston 127 at the tip portion of the anchor 125 is adjusted in response to the position of the anchor 125, so that the fuel-passing area between a slit 122 formed in the piston 127 and the fuel supply portion 129 can be varied to control the fuel supplied to an inlet valve (not shown) in the fuel supply pump 103.

Furthermore, as shown in FIG. 12, in addition to feed the fuel supplied from the feed pump 104 to the proportional control valve 120 and the fuel supply pump 103 under pressure, it is preferable to construct that the fuel is returned to the fuel tank 102 through a overflow valve (OFV) 134 installed in parallel with the proportional control valve 120. Moreover, it is preferable that part of the fuel is fed under pressure to a bearing (not shown) of the fuel supply pump 103 through an orifice 136 installed with the overflow valve 134 and then used as a fuel lubricating oil of the bearing.

By the way, the fuel supply pump 103 is a device for pressurizing the fuel supplied from the feed pump 104 at high pressure as described above. The fuel supply pump 103 is preferably constructed such that, after pressurizing the fuel, the fuel is fed to the common rail 106 under pressure through the high pressure channel 107.

(3) High Pressure Path

Furthermore, as shown in FIG. 11, it is preferable to install a one way valve (not shown) on the outlet of the fuel supply pump 103, or both of the common rail 106 described below and the fuel supply pump 103.

This is because, by the one way valve, the fuel can be only fed from the fuel supply pump 103 to the common rail 106. Therefore, the adverse current at the time of opening an electromagnetic control valve can be effectively prevented to effectively prevent a decrease in pressure in the common rail 106.

(4) Common Rail

Furthermore, as shown in FIG. 11, the common rail 106 is connected to a plurality of injectors (injection valves) 110. Preferably, the accumulated pressure fuel at high pressure by the common rail 106 is injected into an internal combustion engine (not shown) from each of the injectors 110. Furthermore, but not shown in the figure, the amount of discharge from each of these injectors 110 is preferably controlled through an injector driving unit (IDU). The IDU is connected to an electrical controlling unit (ECU) provided as a controller described letter. The IDU is driven by drive signals from the ECU.

Moreover, a pressure detector 117 is connected to the side end of the common rail 106 and a pressure-detection signal obtained by the pressure detector 117 is preferably sent to the ECU. That is, it is preferable to control an electromagnetic control valve (not shown) and also control the drive of IDU in response to the pressure detected when the ECU receives the pressure-detection signal from the pressure detector 117.

(5) Piston Amplifier

Figure 13:
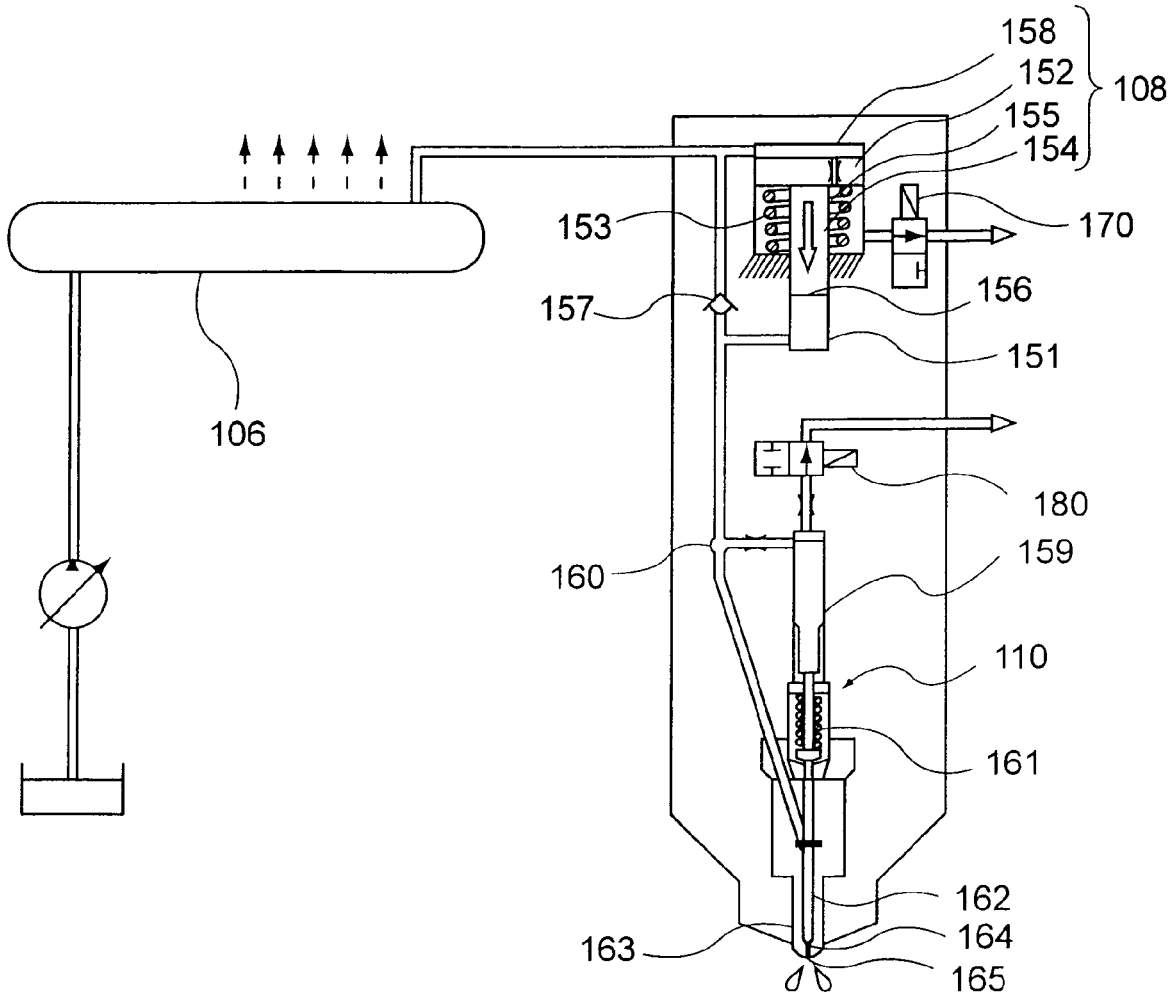
FIG. 13 is a diagram for illustrating the configuration of a mechanically-amplifying accumulator fuel injection device.

Furthermore, as exemplified in FIG. 13, a piston amplifier (pressure amplifying piston) is constructed of a cylinder 155, a mechanical piston 154, a compression chamber 158, an electromagnetic valve 170, and a circulation pathway 157. It is preferable that the mechanical piston 154 is equipped with a pressure-receiving portion 152 having a comparatively large area and a pressure portion 156 having a comparatively small area.

That is, the mechanical piston 154 housed in the cylinder 155 is pushed and moved by the fuel having a common rail pressure at the pressure-receiving portion 152. The common rail pressure of the compression chamber 158 is preferably adjusted to one that allows fuel having a pressure of approximately 30 MPa to be pressurized by the pressure portion 156 having a comparatively small area to make the pressure of the fuel in the range of 150 to 300 MPa.

Furthermore, for pressurizing the mechanical piston 154, a large amount of fuel having the common rail pressure is used. After pressurization, it is preferable to flow the fuel back to the fuel tank or the like through an electromagnetic driven overflow valve 170. That is, a major part of the fuel having the common rail pressure is pressurized by the mechanical piston 154 and then flows back to the fuel tank or the like together with spilled fuel from an electromagnetic valve 180 of the fuel injection system. Then, the fuel is preferably used for pressurizing the mechanical piston 154 again.

On the other hand, the fuel pressurized by the pressure portion 156 is fed to a fuel injection system (fuel injection nozzle) 163, effectively injected, and combusted.

Therefore, providing the piston amplifier as described above, the mechanical piston can be effectively pushed by the fuel having a common rail pressure without excessively increasing the size of the common rail.

Figure 14:
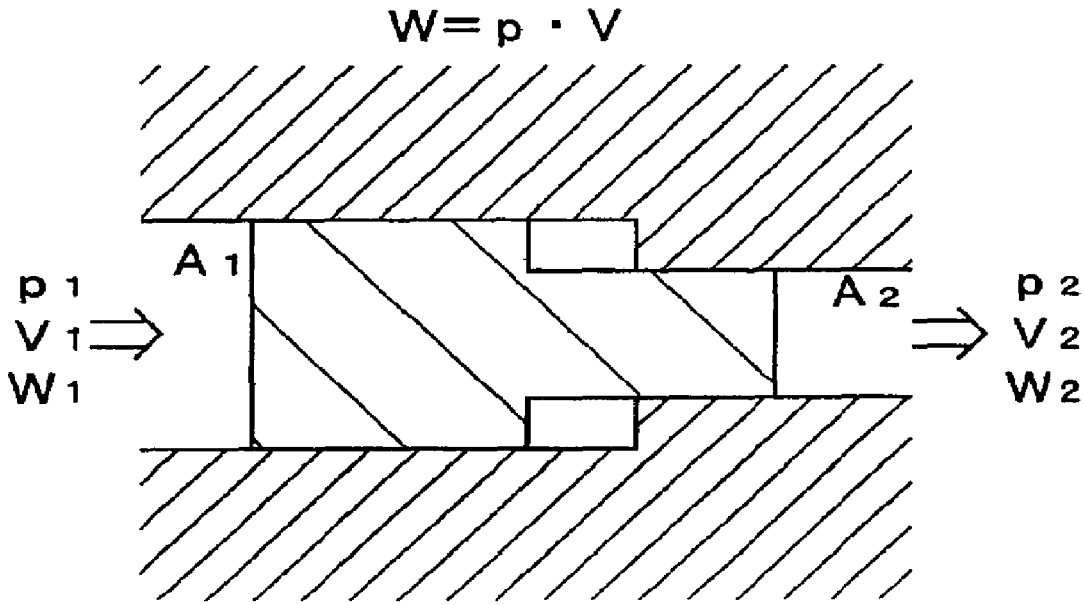
FIG. 14 is a diagram for conceptually illustrating a method of amplifying the pressure of a fuel using a mechanically-amplifying accumulator fuel injection device.

That is, as illustrated in the schematic diagram of FIG. 14, a mechanical piston is equipped with a pressure-receiving portion having a comparatively large area and a pressure portion having a comparatively small area. While considering the stroke of the mechanical piston, it is possible to effectively pressurize the fuel having the common rail pressure to a desired level with a small pressure. More concretely, the fuel from the common rail (pressure: p1, volume: V1, work load: W1) can be received by a pressure-receiving portion having a comparatively large area and then changed to higher-pressure fuel (pressure: p2, volume: V2, work load: W2) by a mechanical piston equipped with a pressure portion having a comparatively small area.

(6) Fuel Injection System (6)-1 Basic Configuration

Furthermore, the configuration of the fuel injection system (fuel injection nozzle) 110 is, but not specifically limited to, preferably constructed as follows: As shown in FIG. 13, for example, the fuel injection system 110 comprises a nozzle body 163. The nozzle body 163 includes: a seat surface 164 on which a needle valve body 162 can be placed; and an injection hole 165 formed on the downstream side from the valve body abutting portion of the seat surface 164. Preferably, it is constructed that the fuel supplied from the upstream side of the seat surface 164 at the time of lifting a needle valve body 162 is introduced into the injection hole 165.

Furthermore, such a fuel injection nozzle system is preferably of an electromagnetic valve type, in which the needle valve body 162 is always energized toward the seat surface 164 by the spring 161 and opens and shuts the needle valve body 162 by switching energization/no energization of solenoid 180.

(6)-2 Injection Timing Chart

Figure 15:
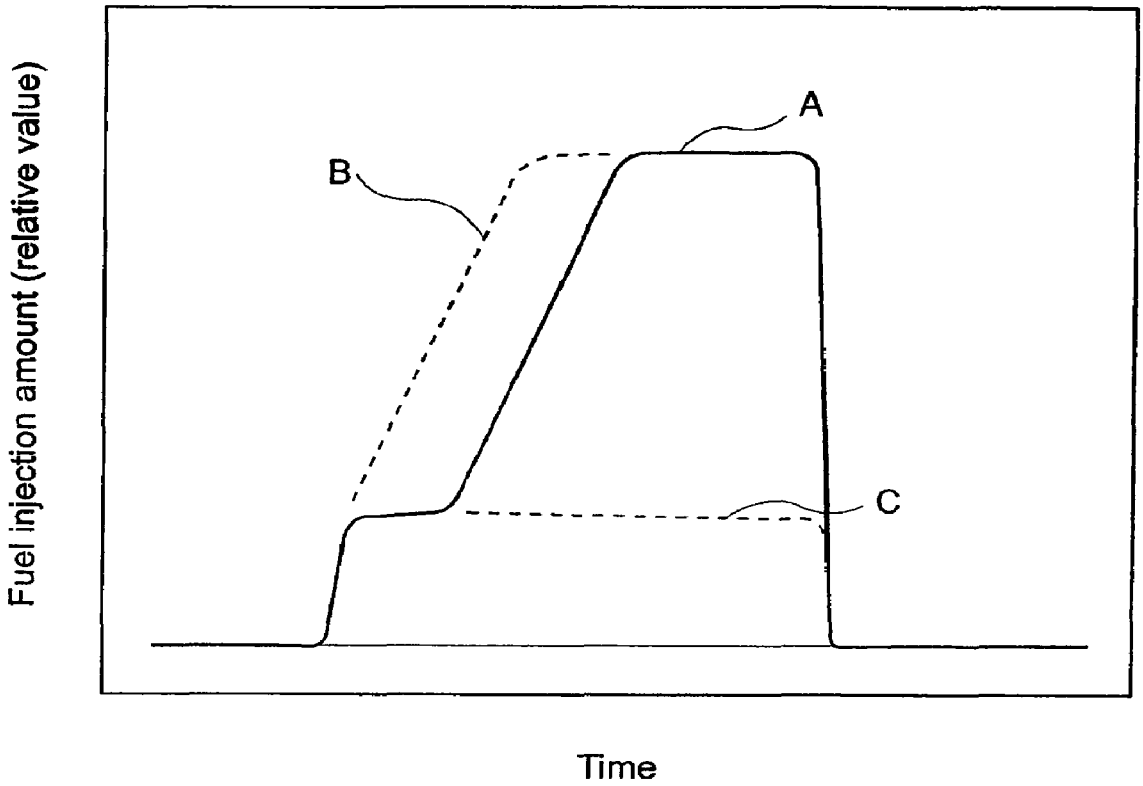
FIG. 15 is a diagram for illustrating a timing chart of high-pressure fuel injection.

Furthermore, as to a timing chart of high-pressure fuel injection, it is preferable to indicate a fuel injection chart having two-staged injection conditions as indicated by the solid line as indicated by the solid line A in FIG. 15.

This is because such a two-stage injection timing chart can be attained by a combination of the common rail pressure and amplification with a piston amplifier, and thus the combustion efficiency of fuel can be raised, while cleaning an exhaust gas.

Furthermore, according to the present invention, it is also preferable to indicate a fuel injection chart as indicated by the dashed line B in FIG. 15, a combination of the common rail pressure and amplification with a piston amplifier.

By the way, when the piston amplifier is not used, the conventional injection timing chart becomes a single-stage injection timing chart with a low injection amount as indicated by the dashed line C in FIG. 15.

(7) Movement

Next, the fuel supply pump 103, the actions of the piston amplifier 108, and the fuel injection valve 110 in the first embodiment will be described. That is, as shown in FIG. 11, at the time of operating the fuel injection system (fuel injection nozzle system), the fuel in the fuel tank 102 is supplied from the feed pump 104 to the fuel supply pump 103. Furthermore, the high-pressure fuel is preferably supplied from the fuel supply pump 103 to the high pressure channel 107 under pressure.

Subsequently, as shown in FIG. 13, the fuel is subjected to pressure accumulation at approximately 50 MPa in the common rail 106 and then the fuel is preferably pressurized under ultra-high pressure conditions of 150 MPa or more as the piston amplifier 108 is provided between the common rail 106 and the fuel injection valve 110.

Second Embodiment

Figure 16:
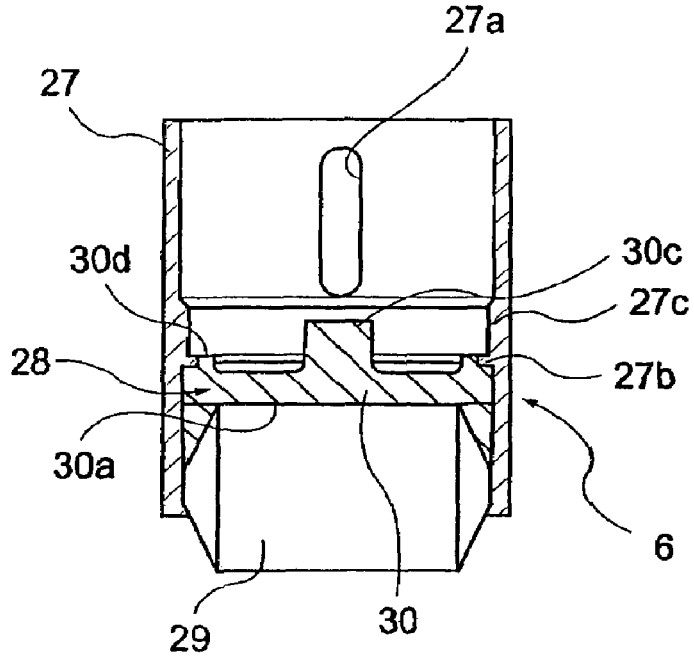
FIG. 16 is a diagram for illustrating an example of the tappet structure body, wherein (a) to (c) are different views of the tappet structure body, respectively (first).
Figure 16:
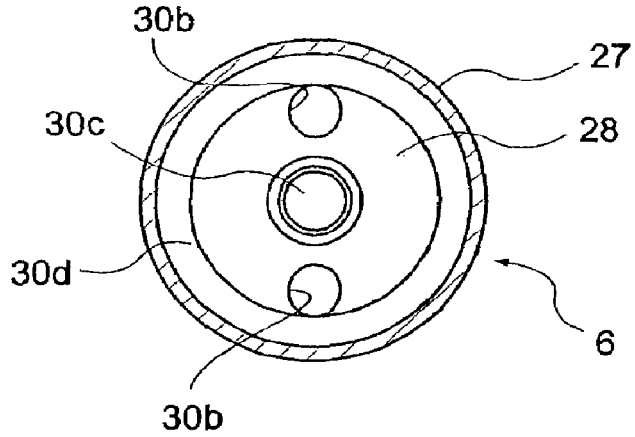
Figure 16:
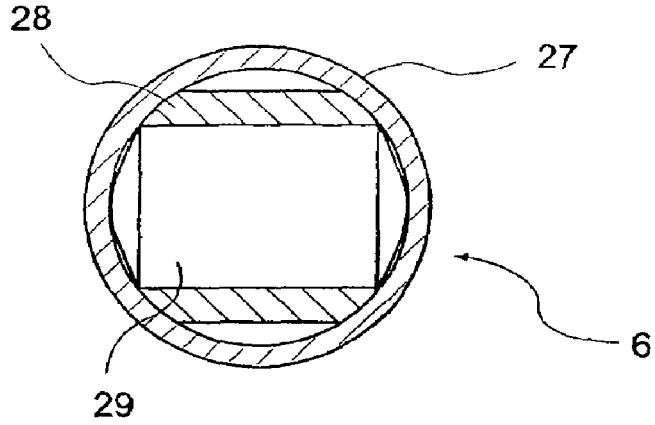

As illustrated in (a) to (c) of FIG. 16, a second embodiment is a tappet structure body 6 having a roller 29 and a roller body 28 wherein the roller body 28 is provided with a pass-through hole 30*b* for allowing the passage of a lubricant or a fuel for lubrication such that the pass-through hole 30*b* penetrates from the upper surface portion to a non-roller portion of the roller body 28. Hereinafter, the basic configuration of the tappet structure body 6 and the roller body 28 having the pass-through hole 30*b* will be more concretely described with reference to the drawings as necessary.

1. Basic Configuration

Figure 17:
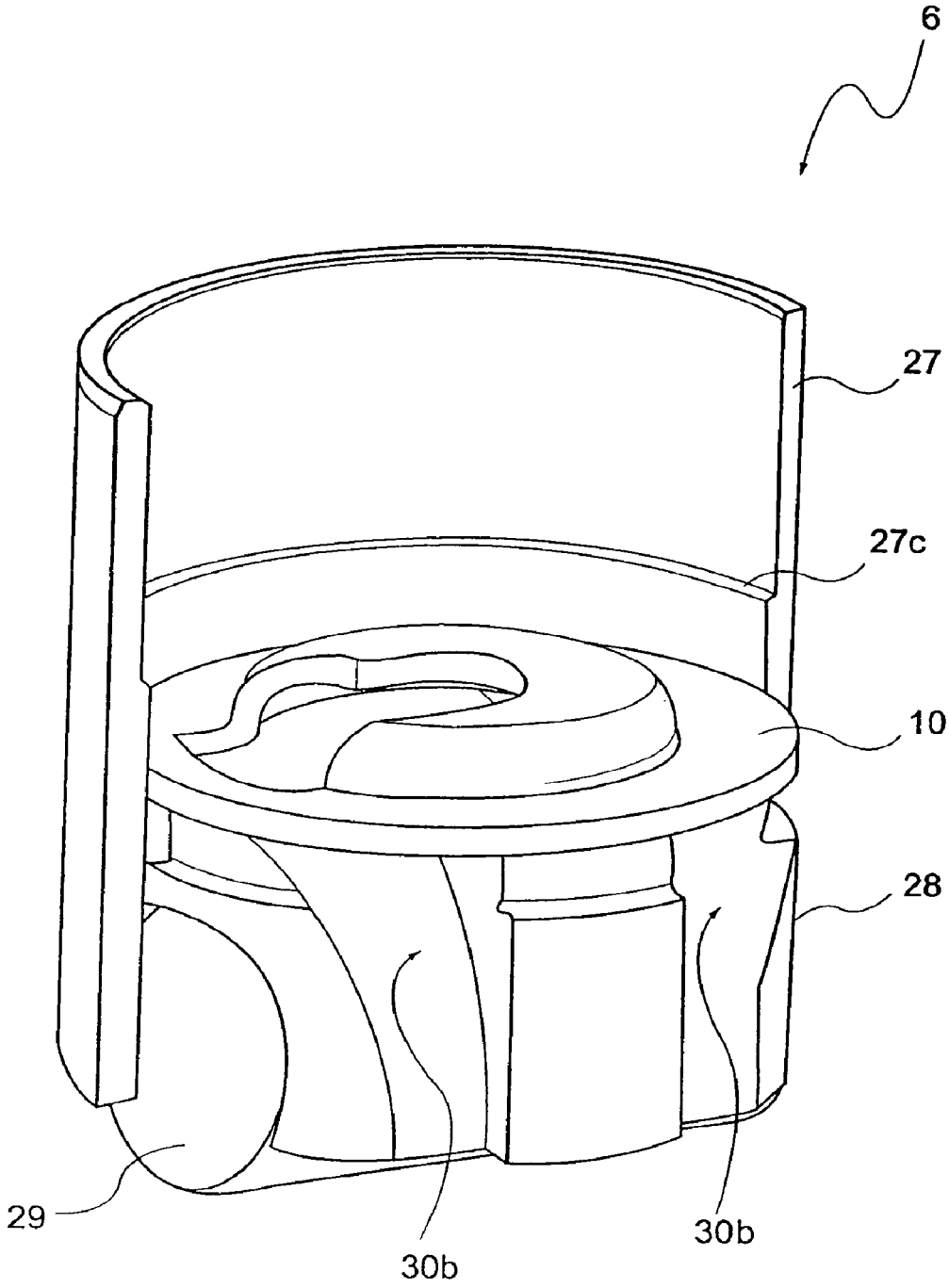
FIG. 17 is a diagram for illustrating another example of the tappet structure body (second).
Figure 18:
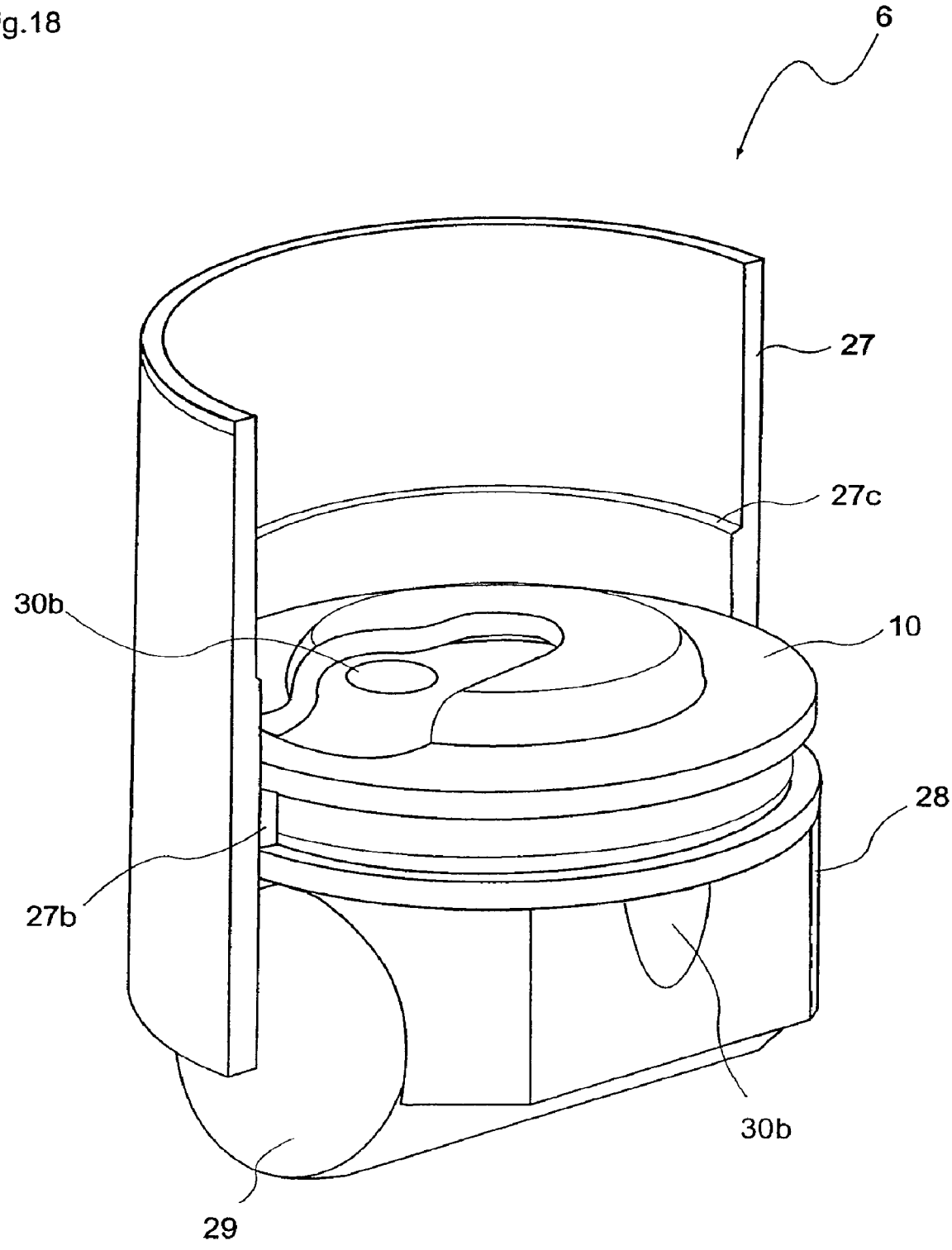
FIG. 18 is a diagram for illustrating another example of the tappet structure body (third).
Figure 19:
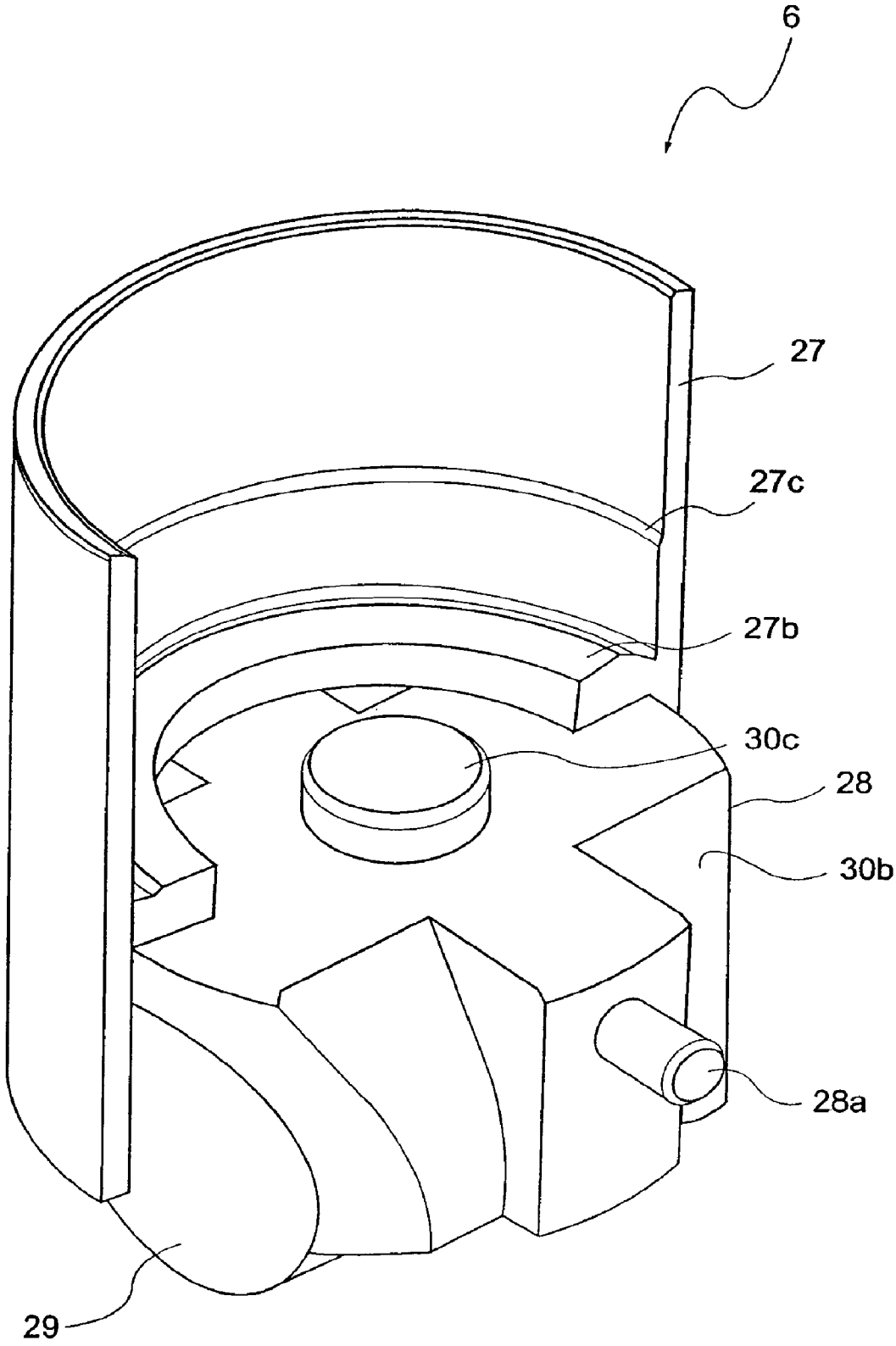
FIG. 19 is a diagram for illustrating another example of the tappet structure body (fourth).
Figure 20:
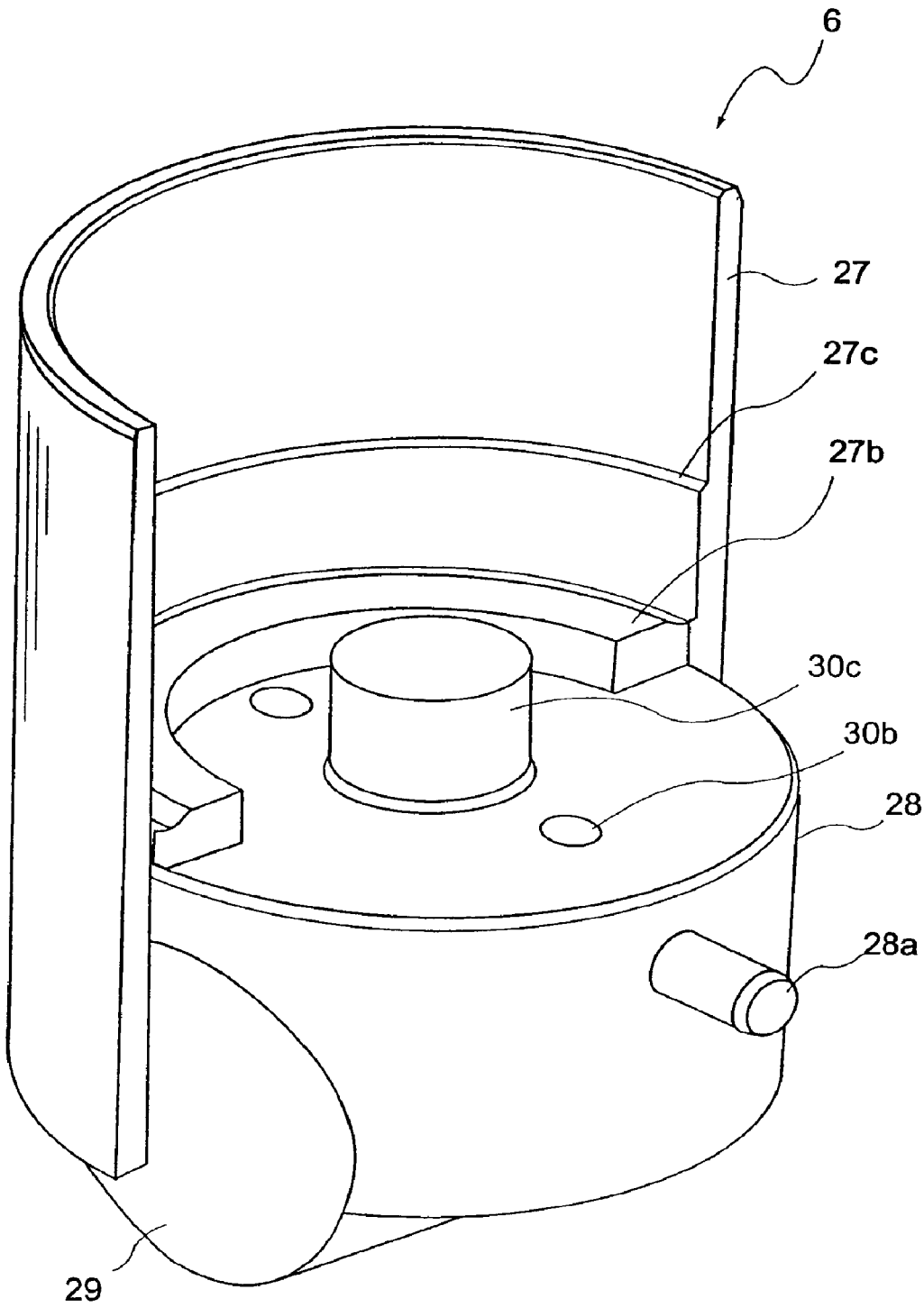
FIG. 20 is a diagram for illustrating another example of the tappet structure body (fifth).

As shown in (a) to (c) of FIG. 16, the tappet structure body 6 is essentially constructed of a shell 27, the roller body 28, and the roller 29. It is preferably constructed to move up and down by the rotary movement of a cam shaft 3 and a cam 60 connected thereto shown in FIG. 1. Still, FIG. 17 and FIG. 18 show the modified example of a tappet structure body 6 containing a shell 27 and a spring sheet 10, and FIG. 19 and FIG. 20 show the modified example of a tappet structure body 6 containing a shell 27, each of which are preferably used.

Preferably, the shell 27 opens from side to side in the vertical direction and forms a cylindrical body having the outer peripheral surface fitted to the peripheral surface of cylindrical spaces 92*b* and 92*c* of a pump housing 52 shown in FIG. 3. Furthermore, on the top of the peripheral wall of the shell 27, an opening (slit) 27*a*, into which a guide pin inserts, is provided and formed as a through-hole extending in the axis direction of the shell 27. This is because the guide pin and the opening 27*a* cooperate to move up and down along the axis of the cylindrical spaces 92*b* and 92*c* for maintaining the movement of the tappet structure body 6 in the required direction, when the tappet structure body 6 moves up and down.

Additionally, on the outer peripheral surface of the shell 27, a first protruded portion 27*b* is preferably provided for restricting the upward movement of the roller body 28. Similarly, on the inner peripheral surface of the shell 27, a second protruded portion 27*c* is provided integrally therewith for guiding the outer peripheral surface of a spring 68. This is because the roller body 28 is not required to have any function for restricting the movement of the spring sheet 26 in the radial direction and is thus allowed to have a simple shape.

On the other hand, the roller 29 is rotationally supported by a roller support 30*a*, the whole surface of which is applied with carbon treatment, for example a carbon coating. Additionally, the roller 29 is constructed to receive the rotation force of the cam 60 communicating into the cam shaft 3. This is because the sliding between the roller 29 and the roller support 30*a* can be controlled by the carbon treatment applied to the roller support 30*a*, and thereby, through the roller 29, the rotation force of the cam 60 can be transferred to the roller support 30 which is a part of the roller body 28, to be efficiently exchanged into the reciprocal movement of a plunger.

Therefore, the tappet structure body 6 as constructed above can reciprocally move at high speed repeatedly for the long term in response to the rotation of the cam 60 communicating into the cam shaft 3.

2. Roller Body (1) Basic Configuration

As shown in FIGS. 16(*a*) to 16(*c*), the roller body 28 preferably has a main body 30 and is held within the shell 27. In addition, its whole body is formed by a plane round-shaped block body composed of a bearing steel. Still, FIG. 21 to FIG. 24 shows the modified example of a roller body 28, each of which can be preferably used.

As shown in FIG. 16(*a*), on the main body 30, the roller support 30, a having the inner peripheral surface fitted to the outer peripheral surface of the roller 29. Furthermore, on the central portion of the upper surface of the main body 30, a contact portion 30*c* is provided integrally with the plunger 54 and protrudes toward the plunger 54. Preferably, on the peripheral portion of the main body 30, a sheet receiver 30*d* for receiving the spring sheet 26 is provided integrally therewith to protrude.

(2) Pass-Through Hole (2)-1 Number and Shape

The number and the shape of the pass-through hole provided on the roller body is note specially limited. For example, the number of the pass-through hole provided in the round shape is preferably in the range of one to ten.

This is because the lubricant or the fuel for lubrication at the side of the spring can be efficiently transferred into the cam side, taking the size and the arrangement thereof into consideration, even if the number of the pass-through hole is one. On the other hand, the pass-through holes more than 10 in number may have a difficulty with the arrangement in the roller body and the formation thereof.

Thus, preferably, the number of the pass-through hole is in the range of two to eight, more preferably in the range of two to six.

If the pass-through hole is provided on the spring sheet located in the upper part of the roller body, the number of the pass-through hole of the roller body is preferably equal to or less than that of the pass-through hole of the spring sheet.

Still, the pass-through hole is preferred to be in the round shape substantially or other wise in the shape of an ellipse, rectangle, deformation, or groove.

(2)-2 Arrangement

As illustrated in FIG. 16(*b*) and FIG. 20, preferably, the pass-through hole 30*b* provided on the roller body 28 is arranged around the roller body in a radial pattern. Still, in an example shown in FIG. 16(*b*), two pass-through holes 30*b* are arranged at the symmetric position with respect to the central protruded portion 30*c*.

This is because this arrangement allows a penetration portion to be easily formed between the spring sheet and the tappet structure body regardless of an assembling alignment of the tappet structure body. Thus even a large amount of fuel can pass through the pass-through holes 30*b* as a part of the penetration portion more rapidly.

Moreover, according to the above arrangement of the pass-through holes, the formation of the respective pass-through holes can be facilitated and further the decline in the mechanical strength of the roller body can be declined.

Figure 21:
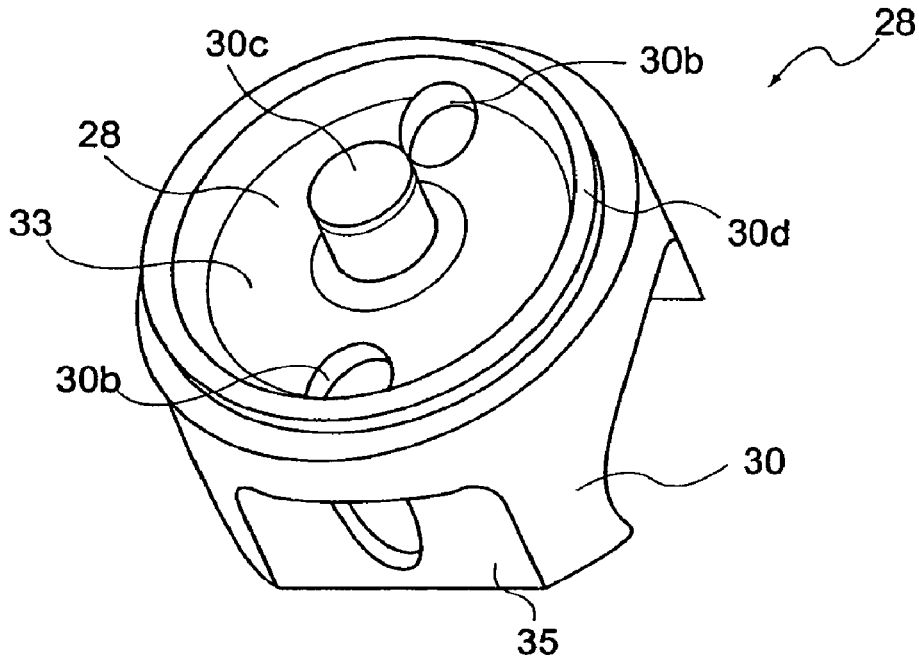
FIG. 21 is a perspective diagram for illustrating a roller body.

As illustrated in FIG. 16(*b*) and FIG. 21 regarding the arrangement of the pass-through hole 30*b*, the pass-through holes 30*b* are preferably provided to diagonally penetrate from the upper surface portion to a non-roller portion of the roller body 28, for example to a side surface portion.

This is because such pass-through holes 30*b* as arranged above are not closed by the movement of the roller. Thus, even if the cam and the plunger are driven at high speed, the lubricant or the fuel for lubrication is allowed to move forward and backward freely between a spring-holding chamber and a cam chamber through such the pass-through holes.

(2)-3 Diameter

The diameter of the pass-through hole 30*b* shown in FIG. 16(*b*) and FIG. 21 is preferably defined in consideration of a fuel-passing amount per unit time and so on. If the pass-through hole 30*b* is substantially in the round shape, its diameter is preferably in the range of 0.5 to 12 mm.

This is because the lubricant or the fuel for lubrication may have a difficulty to move forward and backward freely if the pass-through hole has a diameter less than 0.5 mm. In addition, it is difficult to attain ultra-high pressure conditions of 50 MPa or more in an accumulator fuel injection device used together with a piston amplifier connected to a fuel supply pump.

On the other hand, if the pass-through hole has a diameter more than 12 mm, the mechanical strength and the durability of the roller body may be reduced.

Therefore, the pass-through hole preferably has a diameter in the range of 1 to 10 mm, more preferably in the range of 2 to 6 mm.

(3) Channel

Figure 22:
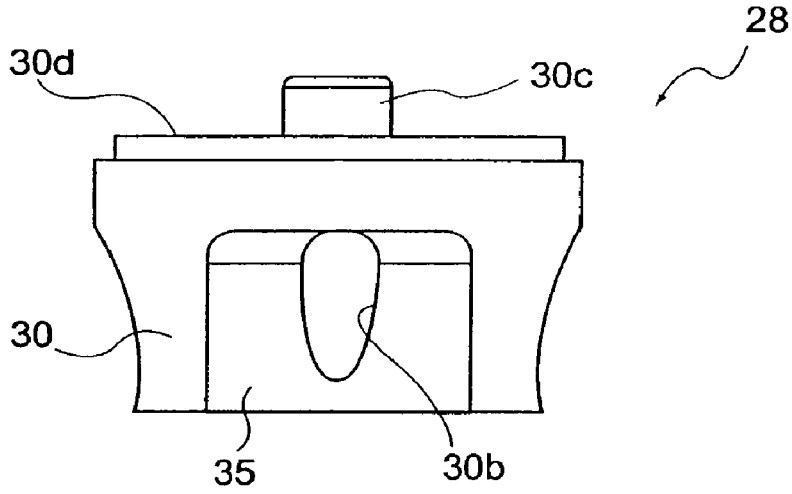
FIG. 22 is a diagram for illustrating the roller body, wherein (a) and (b) are side and cross-sectional views thereof, respectively.
Figure 22:
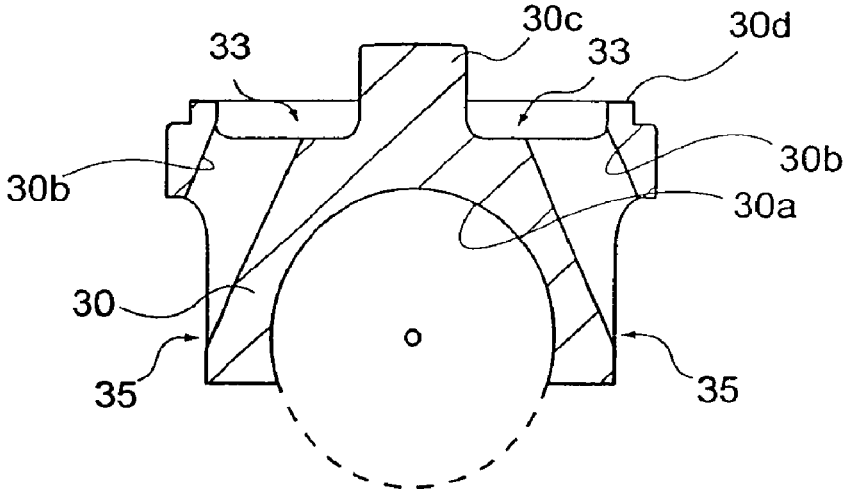
Figure 23:
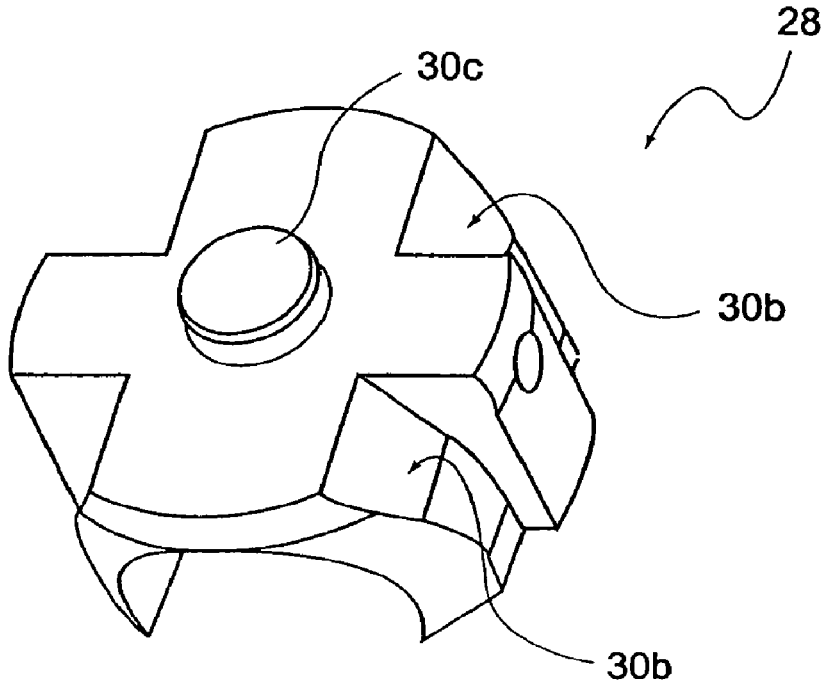
FIG. 23 is a diagram for illustrating another configuration of the roller body (first).
Figure 24:
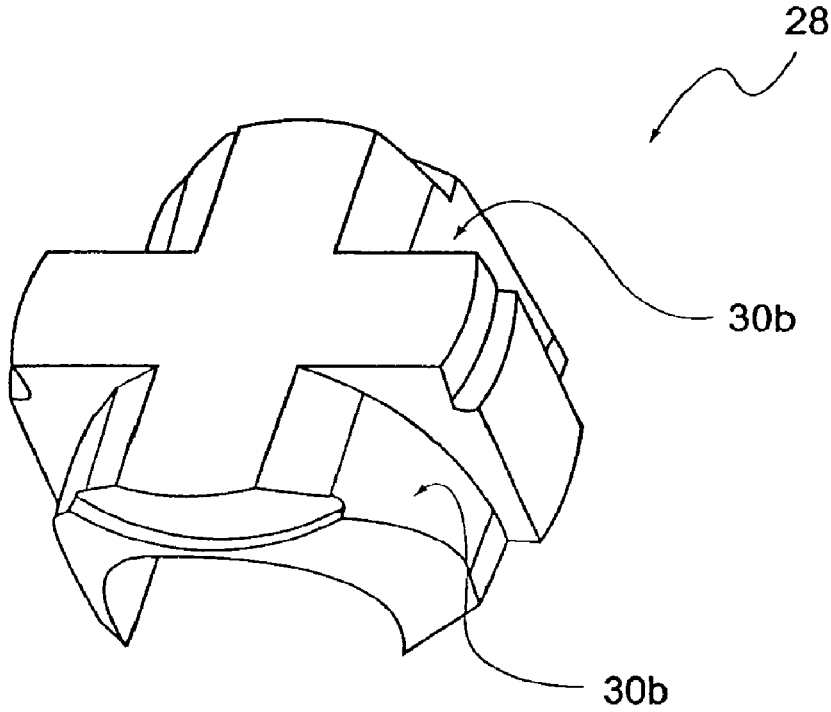
FIG. 24 is a diagram for illustrating another configuration of the roller body (second).
Figure 25:
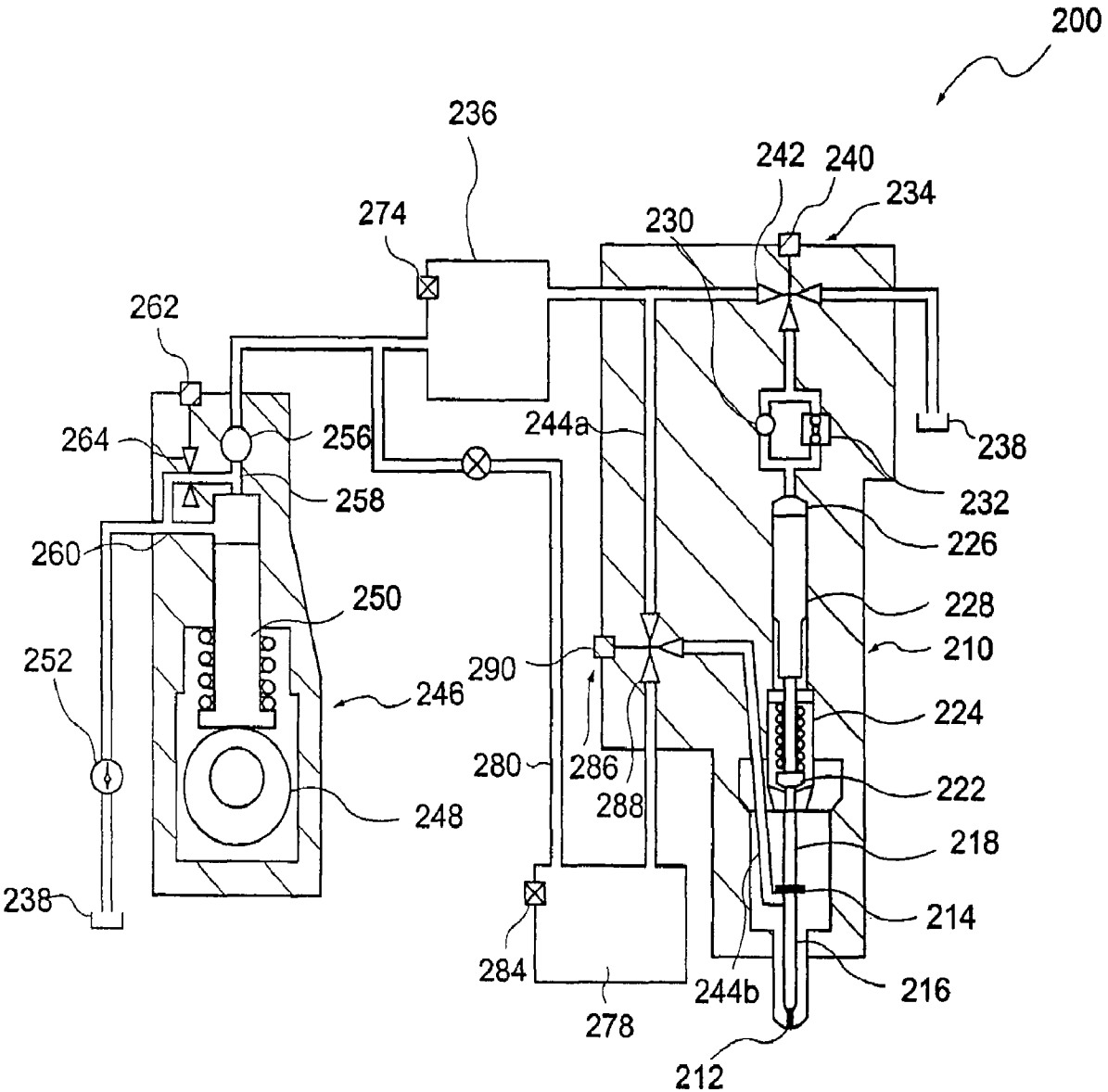
FIG. 25 is a diagram for illustrating the configuration of the conventional accumulator fuel injection device.
Figure 26:
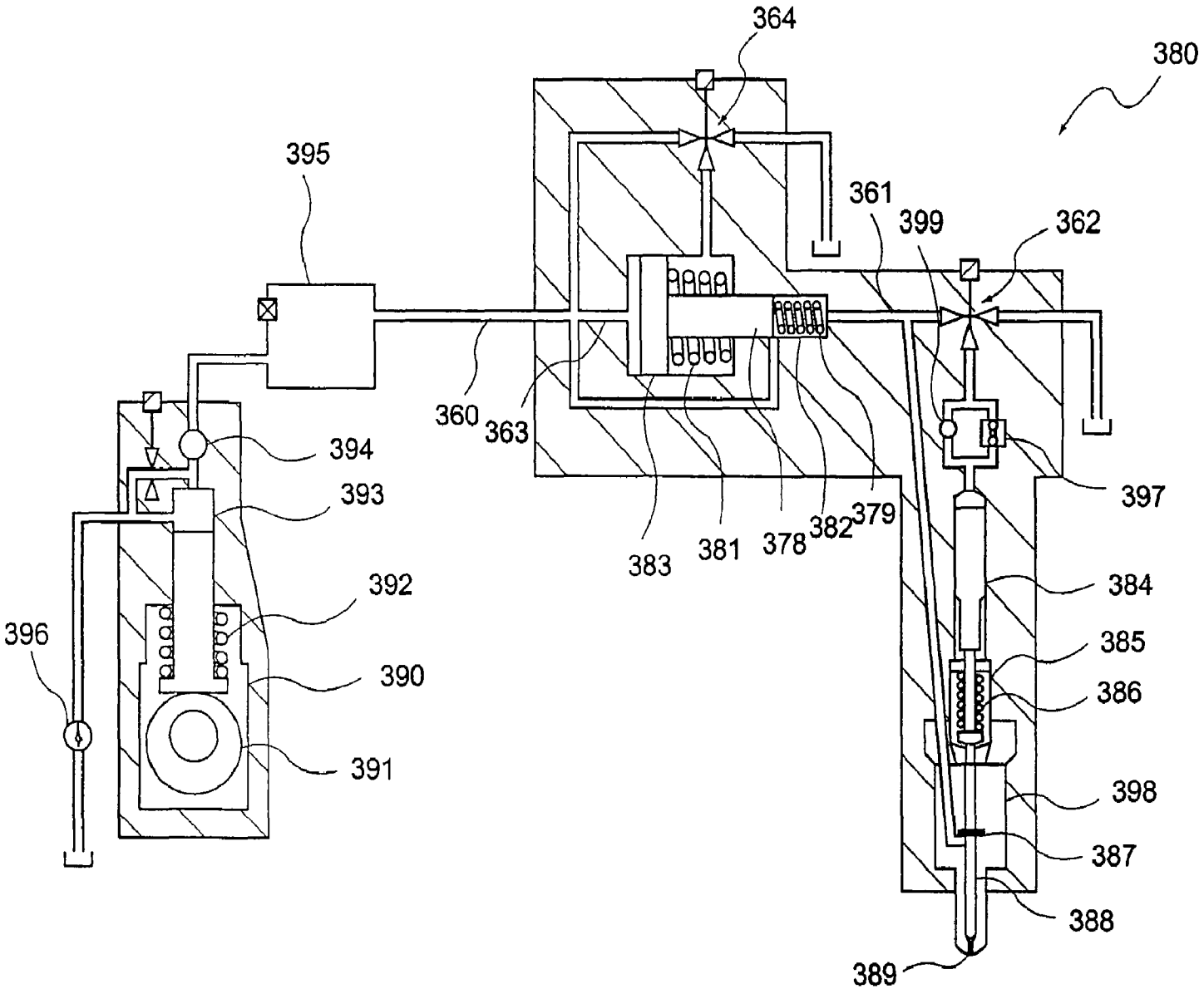
FIG. 26 is a diagram for illustrating the configuration of another conventional accumulator fuel injection device.

As illustrated in FIG. 21 and FIG. 22(*a*) to FIG. 22(*b*), the above pass-through hole 30*b* is preferably provided to penetrate from the upper surface portion to non-roller portion of the roller body 28. In addition, a channel 33 for passing the lubricant or the fuel for lubrication therethrough on the portion which is the upper surface portion of the roller body 28 and contains the opening of the pass-through hole 30*b*.

This is because this formation of the channel can effectively prevent the lubricant or the fuel for lubrication from accumulating in the upper surface portion of the roller body 28. As a result, the lubricant or the fuel for lubrication moves forward and backward freely. Thus, if the cam and the plunger are driven at high speed, a large amount of fuel oil can be pressurized sufficiently.

Furthermore, as illustrated in FIG. 21 and FIG. 22(*a*) to FIG. 22(*b*), the above pass-through hole 30*b* is preferably provided to penetrate from the upper surface portion to a non-roller portion of the roller body 28. In addition, a channel 35 is preferably provided on the area including the lower-side opening of the pass-through hole 30*b* to pass the lubricant or the fuel for lubrication through the channel 35.

This is because this formation of the channel can effectively prevent the lubricant or the fuel for lubrication from accumulating in the lower surface portion of the roller body 28. As a result, the lubricant or the fuel for lubrication moves forward and backward freely. Thus, if the cam and the plunger are driven at high speed, a large amount of fuel oil can be pressurized sufficiently.

Therefore, forming the cannels on the upper and lower portion of the roller body respectively allows fuel to be sufficiently pressurized without inhibiting the movement of the plunger by the lubricant or the fuel for lubrication even in the case of driving the cam and the plunger in the fuel supply pump at high speed and enlarging the amount of fuel discharged.

3. Contact Surface

Furthermore, both of (or either of) the contact surfaces of the roller body and the plunger are preferred to be a curved surface structure.

Although it is not specifically shown in FIGS. 8(*a*) and 8(*b*), the both of (or either of) the contact surfaces of the roller body 28 and the plunger 54 is preferred to be the curved surface structure having the radius of curvature in the range of, for example 30 mm to 2,000 mm.

This is because, even if the cam and the plunger are driven at high speed, introducing such curved surface structure can avoid the unbalanced load between the plunger and the roller body and can prevent the exposure to heat and the damage, resulting in the improvement in durability of the plunger and so on. That is, even though the cam and the plunger in the fuel supply pump are driven at high speed for adapting to a pressure-amplifying accumulator fuel injection device, the durability of the plunger and so on can be improved, and thus fuel is pressurized sufficiently.

INDUSTRIAL APPLICABILITY

As described above, according to the fuel supply pump of the present invention, the predetermined penetration portion is provided. Thereby, even if the plunger is driven at high speed, the lubricant or the fuel for lubrication is allowed to pass through between the spring-holding chamber and the cam chamber quickly and smoothly. Especially, the spring sheet having a certain pass-through hole and the tappet structure body is cooperated. Thereby even a large amount of the lubricant or the fuel for lubrication is allowed to pass through quickly and smoothly.

Thus, the fuel supply pump of the present invention along with the common rail can be suitably used as a fuel supply pump applied to an accumulator fuel injection device (APCRS: Amplified Piston Common Rail System) which mechanically pressurizes fuel through a piston and so on utilizing for example a large flow rate of fuel.

Furthermore, according to the tappet structure body of the present invention, the predetermined pass-through hole is provided. Thereby, pressure pulsation due to the plunger driven at high speed can be decreased and even a large amount of the lubricant or the fuel for lubrication is allowed to pass through quickly and smoothly.

Consequently, even if the tappet structure body of the present invention is used for the fuel injection system having a pressure-amplifying fuel supply pump which mechanically pressurizes a large flow rate of fuel, a large amount of the lubricant or the fuel for lubrication can move forward and backward freely between the spring side and the cam side through the predetermined pass-through hole. Therefore, the plunger can be easily driven at high speed without inhibiting the movement of the plunger by the lubricant or the fuel for lubrication.

The invention claimed is:

1. A fuel supply pump comprising a tappet structural body and a spring sheet, wherein the tappet structural body has a penetration portion for allowing passage of a lubricant or a fuel for lubrication therethrough which is provided between a spring-holding chamber for holding a spring to be used for pushing a plunger against a cam and a cam chamber for housing a cam to be used for moving the plunger up and down, wherein the tappet structural body comprises a roller and a roller body, which roller is rotationally supported by a roller support of the roller body, a pass-through hole for allowing passage of the lubricant or the fuel for lubrication therethrough is formed in the roller body and provided as part of the penetration portion, and the pass-through hole penetrates from a side of the spring-holding chamber of an upper surface of the roller body to a non-roller portion of the roller body which is opened to a side of the cam chamber, whereby the lubricant or the fuel for lubrication is allowed to move backward and forward freely between the spring-holding chamber and the cam chamber.

2. The fuel supply pump as described in claim 1, wherein the spring sheet comprises:

a spring holding portion for holding a spring to be used for pushing the plunger of the fuel supply pump against the cam; and a plunger mounting portion for catching the plunger, where a pass-through hole for allowing passage of a lubricant or a fuel for lubrication therethrough is formed around the plunger mounting portion and provided as part of the penetration portion.

3. The fuel supply pump as described in claim 2, wherein a plurality of the pass-through holes are formed and arranged around the plunger mounting portion in a radial pattern or in a semi-radial pattern.

4. The fuel supply pump as described in claim 1, wherein a plurality of the pass-through holes are formed in the roller body and arranged in a radial pattern with respect to the central point of the upper surface of the roller body.

5. The fuel supply pump as claimed in claim 1, wherein a pass-through hole for allowing passage of a lubricant or a fuel for lubrication therethrough is formed in the roller body and provided as a part of the penetration portion, and a channel for allowing passage of a lubricant or a fuel for lubrication therethrough is formed in an area including an opening of the pass-through hole on an upper surface of the roller body.

6. The fuel supply pump as described in claim 1, wherein a pass-through hole for allowing passage of a lubricant or a fuel for lubrication therethrough is formed in the roller body and provided as a part of the penetration portion, and a channel for allowing passage of a lubricant or a fuel for lubrication therethrough is formed in an area including an opening of the pass-through hole on the lower side thereof.

7. The fuel supply pump as described in claim 1, wherein a fuel lubrication system using part of a fuel oil as a fuel for lubrication is employed and the penetration portion allows passage of the fuel for lubrication therethrough.

8. The fuel supply pump as described in claim 1, wherein the fuel supply pump is used in an accumulator fuel injection device for pressurizing fuel at a flow rate of 500 to 1,500 liters per hour to a value of 50 MPa or more.

* * * * *